US011454143B2

(12) United States Patent
Stone et al.

(10) Patent No.: US 11,454,143 B2
(45) Date of Patent: Sep. 27, 2022

(54) ENGINE VALVE ACTUATION

(71) Applicant: JAGUAR LAND ROVER LIMITED, Warwickshire (GB)

(72) Inventors: Roger Stone, Coventry (GB); Richard Tyrrell, Coventry (GB); David Kelly, Coventry (GB)

(73) Assignee: JAGUAR LAND ROVER LIMITED, Coventry (GB)

( * ) Notice: Subject to any disclaimer, the term of this patent is extended or adjusted under 35 U.S.C. 154(b) by 0 days.

(21) Appl. No.: 17/416,020

(22) PCT Filed: Dec. 19, 2018

(86) PCT No.: PCT/EP2018/085887
§ 371 (c)(1),
(2) Date: Jun. 18, 2021

(87) PCT Pub. No.: WO2020/125970
PCT Pub. Date: Jun. 25, 2020

(65) Prior Publication Data

US 2022/0065139 A1 Mar. 3, 2022

(51) Int. Cl.
*F01L 9/40* (2021.01)
*F01L 9/22* (2021.01)
(Continued)

(52) U.S. Cl.
CPC ..... *F01L 9/40* (2021.01); *F01L 9/22* (2021.01); *F01L 1/30* (2013.01); *F02D 2013/0296* (2013.01)

(58) Field of Classification Search
CPC ..... F01L 1/30; F01L 9/22; F01L 9/40; F02D 2013/0296
(Continued)

(56) References Cited

U.S. PATENT DOCUMENTS 6,202,607 B1 * 3/2001 Kreuter ..... F16K 31/10 123/90.11
2007/0215083 A1 * 9/2007 Seethaler ..... F01L 1/08 123/90.16
2008/0035870 A1 * 2/2008 Wygnanski ..... F01L 1/185 123/90.11

FOREIGN PATENT DOCUMENTS

FR 2823529 A1 * 10/2002 ..... F01L 9/04
FR 2823529 A1 10/2002
(Continued)

OTHER PUBLICATIONS

Combined Search and Examination Report under Sections 17 and 18(3) for Application No. GB1820682 1 dated Jun. 14, 2019.
(Continued)

*Primary Examiner* — Jorge L Leon, Jr.
(74) *Attorney, Agent, or Firm* — Carlson, Gaskey & Olds, P.C.

(57) ABSTRACT

An electromagnetic valve actuator (100) and method of control thereof. The electromagnetic valve actuator is for at least one valve (300) of an internal combustion engine (40), the electromagnetic valve actuator comprising: a rotor (102); a stator (101) for rotating the rotor; output means (104, 106) for actuating the valve in dependence on rotation of the rotor; mechanical energy storage means (108, 110, 116, 118) arranged to store energy in dependence on rotation of the rotor and release the energy to assist rotation of the rotor; and phase varying means (400) for varying a phase between the mechanical energy storage means and the output means.

19 Claims, 9 Drawing Sheets

(51) Int. Cl.
*F01L 1/30* (2006.01)
*F02D 13/02* (2006.01)

(58) Field of Classification Search
USPC ..... 123/90.11, 90.26, 90.31
See application file for complete search history.

(56) References Cited

FOREIGN PATENT DOCUMENTS

| | | | |
|---|---|---|---|
| GB | 2401649 | A | 11/2004 |
| GB | 2554721 | A | 4/2018 |
| GB | 2554722 | A | 4/2018 |

OTHER PUBLICATIONS

International Search Report and Written Opinion of the International Searching Authority for International application No. PCT/EP2018/085887 dated Oct. 1, 2019.
Examination Report under Section 18(3) for Application No. GB1820682.1 dated Apr. 22, 2021.

* cited by examiner

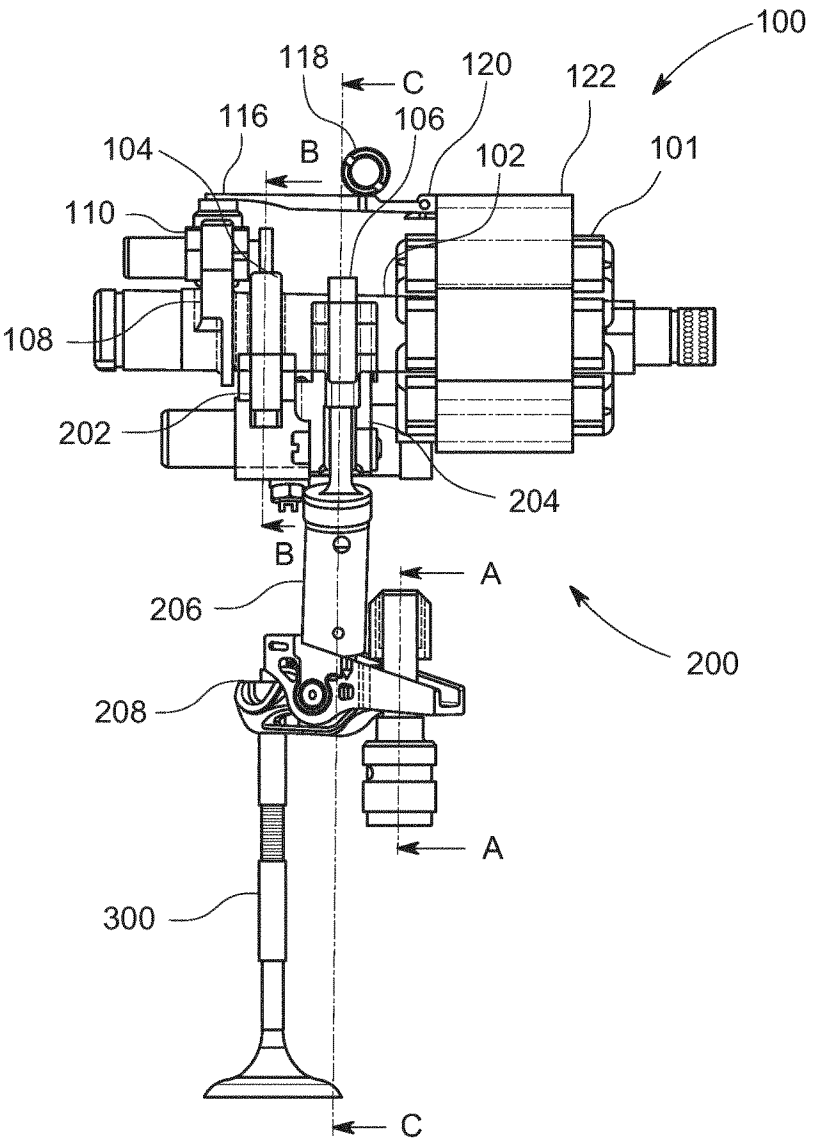
FIG. 3
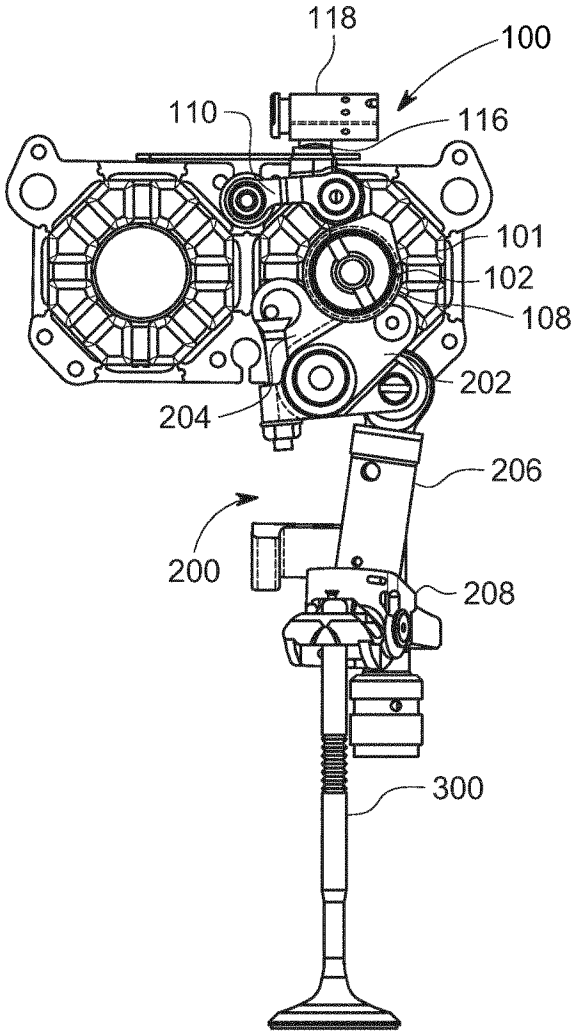

Phase 1

Phase 2

ENGINE VALVE ACTUATION

TECHNICAL FIELD

The present disclosure relates to engine valve actuation, and more particularly to phasing an energy recovery system for an engine valve actuator. In particular, but not exclusively it relates to phasing an energy recovery system for an electromagnetic valve actuator for an engine valvetrain of a vehicle.

The present disclosure also relates to engine valve actuation, and more particularly to rate of energy recovery and release by an energy recovery system of an engine valve actuator. In particular, but not exclusively it relates to rate of energy recovery and release by an energy recovery system of an electromagnetic valve actuator for an engine valvetrain of a vehicle.

The present disclosure also relates to engine valve actuation, and more particularly to varying the quantity of energy stored by an energy recovery system of an engine valve actuator. In particular, but not exclusively it relates to varying the quantity of energy stored by an energy recovery system of an electromagnetic valve actuator for an engine valvetrain of a vehicle.

Aspects of the invention relate to an electromagnetic valve actuator, a controller, a valve actuation system, an internal combustion engine, a vehicle, a method and a computer program.

BACKGROUND

Conventional camshaft-driven engine valvetrains suffer from limited or no adjustability of poppet valve ('valve' herein) timing and lift. Various systems have been derived to enable discrete variable valve lift (VVL) and even continuously variable valve lift (CVVL). CVVL systems enable improved engine efficiency.

Electromagnetic valve actuators (EVAs) can enable CVVL. Since the EVA is not physically coupled to the engine crankshaft, valves can be lifted at any time during a combustion cycle, to any target peak lift.

EVAs present various challenges, such as their parasitic energy consumption and difficulty to package within a vehicle.

SUMMARY OF THE INVENTION

It is an aim of the present invention to address disadvantages of the prior art.

Aspects and embodiments of the invention provide an electromagnetic valve actuator, a controller, a valve actuation system, an internal combustion engine, a vehicle, a method and a computer program as claimed in the appended claims.

Phase Variation

According to an aspect of the invention there is provided an electromagnetic valve actuator for at least one valve of an internal combustion engine, the electromagnetic valve actuator comprising: a rotor; a stator for rotating the rotor; output means (output) for actuating the valve in dependence on rotation of the rotor; mechanical energy storage means (mechanical energy storage device) arranged to store energy in dependence on rotation of the rotor and release the energy to assist rotation of the rotor; and phase varying means (phase varying device) for varying a phase between the mechanical energy storage means and the output means. In some examples the mechanical energy storage means is arranged to store energy to decelerate the rotor and release the energy to accelerate the rotor.

The mechanical energy storage means defines a form of energy recovery system (ERS) which recovers energy from the inertia of the moving parts of the valvetrain. The energy is then released to assist with rotor acceleration, allowing a smaller stator rated at a lower torque. Valvetrain energy consumption is reduced. An advantage of phasing the timing of energy storage and release is that its potential efficiencies are available in a greater variety of operating scenarios. These include at least a scenario in which the inertia is too low for full energy recovery, a scenario of reversing a direction of rotation of the rotor, and a scenario in which the reversal is followed by a full rotation. The scenarios are defined further herein.

In some examples the phase varying means is operable to maintain a first phase between the mechanical energy storage means and the output means, causing the mechanical energy storage means to store energy while the valve is open.

In a first example operating scenario, maintaining the first phase causes the mechanical energy storage means to store the energy while the valve is closing. An advantage is greater efficiency than if the energy storage occurs after valve closing. The energy may then be released after the valve has closed when rotor acceleration is next required.

In a second example operating scenario, the electromagnetic valve actuator is operable to reverse a direction of rotation of the rotor when the valve has reached a target peak lift less than a maximum peak lift, and wherein the mechanical energy storage means causes, at least in part, the reversal. The mechanical energy storage means at the first phase is analogous to a much stiffer valve return spring, enough to cause reversal of rotation. An advantage is less reliance on the stator for supplying negative torque to cause the reversal in a partial lift mode.

In some examples the phase varying means is operable to maintain a second phase between the mechanical energy storage means and the output means, causing the mechanical energy storage means to store energy later with respect to valve opening than in the first phase. An advantage is that when the first phase is no longer useful or efficient, the phasing can occur such that the mechanical energy storage means continues to be useful and efficient for a different type of valve lift event.

In the first example operating scenario, maintaining the second phase may cause the energy storage to occur while the valve is closed. An advantage of retarding the energy storage until after valve closing arises because if the moving parts have insufficient inertia, the mechanical energy storage means could become a parasitic. The stator is burdened with charging the mechanical energy storage means. If the stator has to do this while simultaneously accelerating the rotor to meet a target rotor velocity, the stator may be saturated such that the target rotor velocity cannot be satisfied, and the valve allows too much gas exchange. Therefore, a retarded second phase enables the energy storage to occur when there are no other higher priority loads on the stator.

In the second example operating scenario, having a second phase for partial valve lift mode enables the mechanical energy storage means to optimize the reversal of rotation in dependence on the target peak lift of the valve. For example, if more deceleration is required, the phase could be advanced to cause reversal at the desired timing without the requirement for additional stator braking energy.

Additionally or alternatively, phasing can be useful when transitioning from partial valve lift mode to full valve lift mode. Phasing enables the mechanical energy storage means to assist with reversal in partial valve lift mode (first phase) when required, and to not resist rotation in full valve lift mode when the rotor completes a full cycle with no reversal (second phase). The second phase may store energy while the valve is closing or after the valve has closed, as per the first example operating scenario.

In some examples the second phase is offset from the first phase by a value from the range 10 to 30 degrees. In an example the offset is around 20 degrees.

In some examples the mechanical energy storage means is configured to supply X Nm of torque when releasing the energy to assist rotation of the rotor, wherein the stator is configured to supply up to Y Nm of torque for rotating the rotor, and wherein X is from the range 40% to 95% of Y. In some examples, X is from the range 60-95% of Y. An advantage is that net torque can be close to 2Y without needing more stator windings contained in a larger stator housing. Since the mechanical energy storage means is smaller and lighter than the stator, the valvetrain is lighter and easier to package within a small engine bay such as an automobile engine bay.

In some examples Y is less than a torque required to fully open the valve at an engine speed above 5000 rpm. An advantage is that there is no need for a larger stator housing. At high engine speeds the assistance from ERS is necessary and sufficient to meet target rotor velocity.

In some examples the mechanical energy storage means comprises a resilient member. In some examples the mechanical energy storage means comprises a cantilever spring. This is a highly space-efficient design, for system lightness and ease of packaging.

In some examples the mechanical energy storage means comprises a cam or an eccentric. In some examples the phasing does not change the total amount of energy that the mechanical energy storage means stores or is capable of storing, because the maximum storable energy is defined by the lift of the cam. In some examples the output means comprises a cam or an eccentric. Both cams/eccentrics may be on the same rotor. This design enables a single rotor to perform multiple functions which is mechanically simple and space-efficient.

In some examples the phase varying means is configured to vary the phase of the mechanical energy storage means or the output means relative to the rotor. In some examples the phase varying means is configured to vary the phase of the mechanical energy storage means relative to the rotor. In some examples, the cam is detachable from the rotor, causing the cam to slip relative to the rotor, and the cam is re-attachable to the rotor at a different phase.

In some examples the output means is desmodromic. The output means may comprise an opening lobe and a closing lobe. A desmodromic application enables a target rotor velocity for closing the valve to be higher than a target rotor velocity for opening the valve, enabling skewed valve lifts which can improve combustion efficiency. Beyond the inherent advantages of desmodromic systems, an advantage of phasing the ERS in a desmodromic application is to avoid the situation described above in relation to the first example operating scenario, to enable the target rotor velocity for closing the valve to be achieved.

According to another aspect of the invention there is provided a controller configured to control an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor; and phase varying means for varying a phase between the mechanical energy storage means and the output means, wherein the controller comprises: means to control the phase varying means to vary the phase between the mechanical energy storage means and the output means.

According to a further aspect of the invention there is provided a controller as described above, wherein:

said means to control the phase varying means to vary the phase between the mechanical energy storage means and the output means comprises an electronic processor having one or more electrical inputs for receiving a parameter indicative of a requirement to vary the phase; and an electronic memory device electrically coupled to the electronic processor and having computer program instructions stored therein; the processor being configured to access the memory device and execute the instructions stored therein such that it is operable to determine a requirement to vary the phase based on the parameter, and control the phase varying means in dependence on the determination.

In some examples, 'means to' perform a function comprises: at least one electronic processor; and at least one electronic memory device electrically coupled to the electronic processor and having instructions stored therein, the at least one electronic memory device and the instructions configured to, with the at least one electronic processor, perform the function.

In some examples the controller comprises means to receive a parameter indicative of kinetic energy (inertia of rotating parts), and to control the phase varying means to vary the phase from a second phase that causes the mechanical energy storage means to store energy after closing of the valve, to a first phase that causes the mechanical energy storage means to store energy during closing of the valve, when the parameter exceeds a threshold. In some examples the parameter is engine speed-dependent. For example the engine-speed dependent parameter could be engine speed or target rotor velocity. This relates to the first example operating scenario. Low rotor velocity or engine speed are example parameters for identifying when the mechanical energy storage means is parasitic rather than functioning as an ERS.

Regarding the first example operating scenario, in some examples the controller comprises means to control the stator while the second phase is in operation, to apply torque to the rotor after closing of the valve to cause the mechanical energy storage means to store energy after closing of the valve. As described above, the phasing is useful when inertia is low because the stator will need to apply torque to charge the (parasitic) mechanical energy storage means. In some examples the controller comprises means to control the stator while at least the second phase is in operation, to apply torque to the rotor during closing of the valve. As described above, the phasing is useful when inertia is low because the stator will need to apply torque prior to valve closing to meet a target rotor velocity for valve closing.

In some examples the controller comprises means to determine a required change from a partial valve lift mode to a full valve lift mode, wherein the partial valve lift mode requires the electromagnetic valve actuator to reverse a direction of rotation of the rotor when the valve has reached a target peak lift less than a maximum peak lift, and comprising means to control the phase varying means to vary the phase from a second phase that causes the mechanical energy storage means to cause, at least in part, reversal of the valve, to a first phase in which energy storage does not occur prior to maximum peak lift. As described above, the phasing is useful when transitioning from partial valve lift mode to full valve lift mode. The determination may arise from an engine control unit map relating engine speed and load to a desired target rotor velocity and efficient valve lift.

Regarding the second example operating scenario, in some examples the controller comprises means to determine a required change of target peak lift of the valve less than a maximum peak lift of the valve, wherein the target peak lift requires the electromagnetic valve actuator to reverse a direction of rotation of the rotor when the valve has reached the target peak lift, wherein the phase is changed in dependence on the required change of target peak lift. As described above, the phasing is useful for optimizing the reversal of rotation by minimizing a stator energy requirement for the reversal. This determination may also arise from said engine control unit map.

According to a further aspect of the invention there is provided a valvetrain comprising the electromagnetic valve actuator, a valve, and a mechanism for coupling the electromagnetic valve actuator to the valve.

According to a further aspect of the invention there is provided a valve actuation system comprising the electromagnetic valve actuator and the controller.

According to a further aspect of the invention there is provided an internal combustion engine comprising the electromagnetic valve actuator or the controller or the valve actuation system.

According to a further aspect of the invention there is provided a vehicle comprising the internal combustion engine.

According to a further aspect of the invention there is provided a method of controlling an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor; and phase varying means for varying a phase between the mechanical energy storage means and the output means, wherein the method comprises: controlling the phase varying means to vary the phase between the mechanical energy storage means and the output means.

According to a further aspect of the invention there is provided a computer program that, when run on at least one electronic processor, causes at least: controlling an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor; and phase varying means for varying a phase between the mechanical energy storage means and the output means, such that: the valve phase varying means is controlled to vary the phase between the mechanical energy storage means and the output means.

According to a further aspect of the invention there is provided a non-transitory tangible physical entity embodying a computer program comprising computer program instructions that, when executed by at least one electronic processor, enable a controller at least to perform any one or more of the methods described herein.

According to a further aspect of the invention the mechanical energy storage means as described above is not necessarily mechanical but could be any energy storage means, e.g. electrical or chemical.

Asymmetric Energy Storage Cam

According to an aspect of the invention there is provided an electromagnetic valve actuator for at least one valve of an internal combustion engine, the electromagnetic valve actuator comprising: a rotor; a stator for rotating the rotor; output means (output) for actuating the valve in dependence on rotation of the rotor; and mechanical energy storage means (mechanical energy storage device) arranged to store energy in dependence on rotation of the rotor and release the energy to assist rotation of the rotor; wherein the mechanical energy storage means comprises a cam means (cam), the cam means having an asymmetric profile. In some examples, the cam means comprises an energy storage flank for enabling the mechanical energy storage means to store energy, and an energy release flank for enabling the mechanical energy storage means to release the energy, wherein the asymmetric profile comprises the energy storage flank having a different profile from the energy release flank.

The mechanical energy storage means defines a form of energy recovery system (ERS) which recovers energy from the inertia of the moving parts of the valvetrain. The energy is then released to assist with rotor acceleration, allowing a smaller stator rated at a lower torque. Valvetrain energy consumption is reduced. An advantage of asymmetric cam means is that the rotor deceleration during energy storage, and/or rotor acceleration during energy release, is optimized. This optimization could reduce the amount of stator torque required to achieve a required acceleration or deceleration. The power loss is reduced because less stator torque over a longer period consumes less power than more stator torque over a shorter period. Stator torque requires stator current and power loss is proportional to the square of current (I2R).

In some examples, the asymmetric profile comprises the energy storage flank having a lower average steepness than the energy release flank. An advantage is optimizing rotor deceleration during energy storage. This is because a situation may arise in which the stator is burdened with applying torque to fully charge the mechanical energy storage means. This situation may arise when inertia is too low for full energy recovery (e.g. low engine speed), causing the mechanical energy storage means to be a parasitic. By reducing the steepness, the parasitic effect is reduced because I2R losses are optimized. The energy release flank has a greater steepness, which may be adapted to the rate of energy release of the mechanical energy storage means. The greater steepness of the energy release flank may ensure that the cam means remains in continuous contact with the mechanical energy storage means during energy release. This improves efficiency because lost motion between the mechanical energy storage means and the energy release flank is avoided. If the steepness were insufficient, the stator may need to accelerate the rotor during the release of energy by the mechanical energy storage means to achieve a target rotor velocity for a valve lift event, so that the cam means would no longer be in contact with the mechanical energy storage means.

In some examples, the cam means comprises a single lobe having the energy storage flank and the energy release flank. An advantage is more space efficient packaging as the rotor does not have to be long enough to provide two lobes.

In some examples, the output means is desmodromic. A desmodromic application enables a target rotor velocity for closing the valve to be higher than a target rotor velocity for opening the valve, enabling skewed valve lifts which can improve combustion efficiency. Beyond the inherent advantages of desmodromic systems, an advantage of a shallower energy storage flank is to avoid a situation which can arise when the mechanical energy storage means is parasitic for the reason described above. In this situation, the stator is burdened with charging the mechanical energy storage means. If the stator has to do this while simultaneously accelerating the rotor to meet a target rotor velocity for closing the valve, the stator may be saturated such that the target rotor velocity cannot be satisfied, and the valve allows too much gas exchange. Therefore, a shallower energy recovery side of the cam means for a desmodromic application reduces the maximum in-service stator torque, allowing for a smaller and lighter stator.

In some examples the mechanical energy storage means is configured to supply X Nm of torque when releasing the energy to assist rotation of the rotor, wherein the stator is configured to supply up to Y Nm of torque for rotating the rotor, and wherein X is from the range 40% to 95% of Y. In some examples, X is from the range 60-95% of Y. An advantage is that net torque can be close to 2Y without needing more stator windings contained in a larger stator housing. Since the mechanical energy storage means is smaller and lighter than the stator, the valvetrain is lighter and easier to package within a small engine bay such as an automobile engine bay.

In some examples, Y is less than a torque required to fully open the valve at an engine speed above 5000 rpm. An advantage is that there is no need for a larger stator housing. At high engine speeds the assistance from ERS is necessary and sufficient to meet target rotor velocity.

In some examples, the mechanical energy storage means comprises a resilient member. In some examples, the mechanical energy storage means comprises a cantilever spring. This is a highly space-efficient design, for system lightness and ease of packaging.

In some examples, the output means comprises an output cam means for actuating the valve. The output cam means may also be located on the rotor for space-efficiency.

In some examples, the cam means is oriented such that peak lift of the cam means occurs between closing of the valve and the next opening of the valve. The rotor could be held stationary at a park position while the cam means is at peak lift. The park position could be aligned with a detent location for minimal cogging torque.

According to another aspect of the invention there is provided a controller for an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor, wherein the mechanical energy storage means comprises a cam means the cam means having an asymmetric profile, wherein the controller comprises:

means to control the stator to provide assistive torque for the rotor to rotate past an energy storage flank of the cam means. An advantage is to ensure that the cam means is at peak lift when the rotor settles in the park position.

According to a further aspect of the invention there is provided a controller as described above, wherein:

said means to control the stator to provide assistive torque for the rotor to rotate past an energy storage flank of the cam means comprises an electronic processor having one or more electrical inputs for receiving a parameter indicative of a requirement to perform said control; and an electronic memory device electrically coupled to the electronic processor and having computer program instructions stored therein; the processor being configured to access the memory device and execute the instructions stored therein such that it is operable to determine a requirement to perform said control, and perform said control in dependence on the determination.

In some examples, 'means to' perform a function comprises: at least one electronic processor; and at least one electronic memory device electrically coupled to the electronic processor and having instructions stored therein, the at least one electronic memory device and the instructions configured to, with the at least one electronic processor, perform the function.

In some examples, the controller comprises means to control the stator to provide torque for desmodromically closing the valve, while at the same time providing the assistive torque. An advantage is that a higher target rotor velocity for closing the valve is available while simultaneously providing the assistive torque, without exceeding maximum stator current.

According to a further aspect of the invention there is provided a valve actuation system comprising the electromagnetic valve actuator and the controller.

According to a further aspect of the invention there is provided an internal combustion engine comprising the electromagnetic valve actuator or the controller or the valve actuation system.

According to a further aspect of the invention there is provided a vehicle comprising the internal combustion engine.

According to a further aspect of the invention there is provided a method of controlling an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor, wherein the mechanical energy storage means comprises a cam means the cam means having an asymmetric profile, wherein the method comprises: controlling the stator to provide assistive torque for the rotor to rotate past an energy storage flank of the cam means.

According to a further aspect of the invention there is provided a computer program that, when run on at least one electronic processor, causes at least: controlling an electromagnetic valve actuator for at least one valve of an internal combustion engine, the electromagnetic valve actuator comprising: a rotor; a stator for rotating the rotor; output means for actuating the valve in dependence on rotation of the rotor; mechanical energy storage means arranged to store energy in dependence on rotation of the rotor and release the energy to assist rotation of the rotor, wherein the mechanical energy storage means comprises a cam means the cam means having an asymmetric profile, such that: the stator is controlled to provide assistive torque for the rotor to rotate past an energy storage flank of the cam means.

According to a further aspect of the invention there is provided a non-transitory tangible physical entity embodying a computer program comprising computer program instructions that, when executed by at least one electronic processor, enable a controller at least to perform any one or more of the methods described herein.

According to a further aspect of the invention the mechanical energy storage means as described above is not necessarily mechanical but could be any energy storage means, e.g. electrical or chemical.

Energy Storage Control

According to a first aspect of the invention there is provided an electromagnetic valve actuator for at least one valve of an internal combustion engine, the electromagnetic valve actuator comprising: a rotor; a stator for rotating the rotor; mechanical energy storage means (mechanical energy storage device) arranged to store energy in dependence on rotation of the rotor and release the energy to assist rotation of the rotor, wherein the mechanical energy storage means comprises control means (control device) to control the amount of energy stored in the mechanical energy storage means by the end of a period of rotation of the rotor in a first direction, between a first positive amount and a second positive amount.

The mechanical energy storage means defines a form of energy recovery system (ERS) which recovers energy from the inertia of the moving parts of the valvetrain. The energy is then released to assist with rotor acceleration, allowing a smaller stator rated at a lower torque. Valvetrain energy consumption is reduced. An advantage of control means is that the mechanical energy storage means is controllable based on the amount of inertia available to most efficiently capture the energy and mitigate a scenario in which the mechanical energy storage means could become parasitic. The mechanical energy storage means could become parasitic if there is insufficient inertia, requiring the stator to instead 'charge' the mechanical energy storage means.

In some examples the mechanical energy storage means comprises a resilient member. In some examples the mechanical energy storage means comprises a cantilever spring. This spring arrangement provides a highly space-efficient design, for system lightness and ease of packaging.

In some examples the control means is configured to change a characteristic of a fulcrum of the resilient member to vary the quantity of energy storable in the mechanical energy storage means. This 'active fulcrum' can advantageously tune the mechanical energy storage means to the amount of available inertia.

In a first example implementation the control means comprises staging means (staging device) for controlling staged actuation of the mechanical energy storage means. In some examples the staging means controls the relative duration of a first stage of actuation of the mechanical energy storage means and a second stage of actuation of the mechanical energy storage means, wherein in the first stage of actuation less energy is stored in the mechanical energy storage means. In some examples the first stage is a lost motion stage in which no energy is stored in the mechanical energy storage means. In some examples the staging means comprises a fulcrum, wherein the fulcrum comprises a cylinder having a plurality of cross-sectional radii. The fulcrum could therefore be described as an active fulcrum. In some examples the staging means comprises a deactivated position, e.g. deactivated cross-sectional radius, allowing no energy to be stored in the mechanical energy storage means. An advantage is that the mechanical energy storage means can be controlled with few moving parts such as a rotary actuator, to tune the mechanical energy storage means (e.g. spring) to the available inertia.

In a second example implementation the control means comprises lever arm length adjusting means (lever arm length adjuster) for adjusting the length of a lever arm of the mechanical energy storage means, the length of the lever arm controlling energy storable by the mechanical energy storage means. In some examples the lever arm length adjusting means is configured to adjust the length of the lever arm by adjusting fulcrum location, using an active fulcrum which can be translationally moved relative to the lever arm. In some examples the lever arm length adjusting means is substantially continuously movable between two locations. An advantage is that the mechanical energy storage means can be controlled with few moving parts such as a rotary actuator, to tune the mechanical energy storage means (e.g. spring) to the available inertia.

In a third example implementation other than the active fulcrum described above, the control means comprises cam means (cam), the cam means having a staged profile. In some examples the staged profile comprises a first stage of the cam means defining a first park position in which the rotor can cease rotation at the end of a period of rotation of the rotor such that the amount of energy stored in the mechanical energy storage means corresponds to the first positive amount, and a second stage defining a second park position in which the rotor can cease rotation at the end of a period of rotation of the rotor such that the amount of energy stored in the mechanical energy storage means corresponds to the second positive amount. In some examples the first stage comprises a plateau in a flank of the cam means, and the second stage comprises the nose of the cam means. An advantage is that the energy storage can be controlled simply by stopping the rotor at the first park position before reaching the lobe nose, when available inertia is low. Therefore, a parasitic region between the first park position and the lobe nose can be avoided. The stator can then rotate the rotor in reverse to perform the next valve lift event or can climb the remaining parasitic region when there are no other higher priority demands on the stator, such as achieving a particular target rotor velocity for a valve lift event.

In some examples two or more of the first implementation, the second implementation or the third implementation can be combined to enable a finer level of control.

In some examples the mechanical energy storage means is configured to supply X Nm of torque when releasing the energy to assist rotation of the rotor, wherein the stator is configured to supply up to Y Nm of torque for rotating the rotor, wherein X is from the range 40% to 95% of Y. In some examples, X is from the range 60-95% of Y. An advantage is that net torque can be close to 2Y without needing more stator windings contained in a larger stator housing. Since the mechanical energy storage means is smaller and lighter than the stator, the valvetrain is lighter and easier to package within a small engine bay such as an automobile engine bay.

In some examples Y is less than a torque required to fully open the valve at an engine speed greater than 5000 rpm. An advantage is that there is no need for a larger stator housing. At high engine speeds the assistance from ERS is necessary and sufficient to meet target rotor velocity.

In some examples the electromagnetic valve actuator is desmodromic. The output means may comprise an opening lobe and a closing lobe. A desmodromic application enables a target rotor velocity for closing the valve to be higher than a target rotor velocity for opening the valve, enabling skewed valve lifts which can improve combustion efficiency. Beyond the inherent advantages of desmodromic systems, an advantage of phasing the ERS in a desmodromic application is to avoid the situation described above in relation to the first example operating scenario, to enable the target rotor velocity for closing the valve to be achieved.

According to a further aspect of the invention there is provided an electromagnetic valve actuator for at least one valve of an internal combustion engine, the electromagnetic valve actuator comprising: a rotor; a stator for rotating the rotor; mechanical energy storage means arranged to store energy in dependence on rotation of the rotor and release the energy to assist rotation of the rotor, wherein the mechanical energy storage means comprises cam means, the cam means having a staged profile. This relates to at least the third example implementation.

According to a further aspect of the invention there is provided a controller configured to control an electromagnetic valve actuator for at least one valve of an internal combustion engine, the electromagnetic valve actuator comprising: a rotor; a stator for rotating the rotor; mechanical energy storage means arranged to store energy in dependence on rotation of the rotor and release the energy to assist rotation of the rotor, wherein the mechanical energy storage means comprises control means to control the amount of energy stored in the mechanical energy storage means by the end of a period of rotation of the rotor in a first direction, between a first positive amount and a second positive amount, wherein the controller comprises: means to cause the control means to control the amount of energy stored in the mechanical energy storage means by the end of a period of rotation of the rotor in a first direction, between at least the first positive amount and the second positive amount. This enables tuning of the mechanical energy storage means to the amount of available inertia.

According to a further aspect of the invention there is provided a controller as described above, wherein:

said means to cause the control means comprises an electronic processor having one or more electrical inputs for receiving a parameter indicative of a requirement to perform said control; and an electronic memory device electrically coupled to the electronic processor and having computer program instructions stored therein; the processor being configured to access the memory device and execute the instructions stored therein such that it is operable to determine a requirement to perform said control in dependence on the parameter, and perform said control in dependence on the determination.

In some examples, 'means to' perform a function comprises: at least one electronic processor; and at least one electronic memory device electrically coupled to the electronic processor and having instructions stored therein, the at least one electronic memory device and the instructions configured to, with the at least one electronic processor, perform the function.

In some examples the controller comprises means to control the control means in dependence on a parameter indicative of kinetic energy. In some examples the parameter is engine speed-dependent. For example the engine-speed dependent parameter could be engine speed or target rotor velocity. In some examples the controller comprises means to control the control means to increase the quantity of energy stored to the second positive amount when the parameter increases above a threshold. Low engine speed or rotor velocity is an example parameter for identifying when the mechanical energy storage means is parasitic.

In some examples the controller comprises means to reverse the direction of rotation of the rotor for a subsequent period of rotation of the rotor. This relates to at least the third example implementation. An advantage is there is no need to climb the parasitic region to the lobe nose.

According to a further aspect of the invention there is provided a valve actuation system comprising the electromagnetic valve actuator and the controller.

According to a further aspect of the invention there is provided an internal combustion engine comprising the electromagnetic valve actuator or the controller or the valve actuation.

According to a further aspect of the invention there is provided a vehicle comprising the internal combustion engine.

According to a further aspect of the invention there is provided a method of controlling an electromagnetic valve actuator for at least one valve of an internal combustion engine, the electromagnetic valve actuator comprising: a rotor; a stator for rotating the rotor; mechanical energy storage means arranged to store energy in dependence on rotation of the rotor and release the energy to assist rotation of the rotor, wherein the mechanical energy storage means comprises control means to control the amount of energy stored in the mechanical energy storage means by the end of a period of rotation of the rotor in a first direction, between a first positive amount and a second positive amount, wherein the method comprises: causing the control means to control the amount of energy stored in the mechanical energy storage means by the end of a period of rotation of the rotor in a first direction, between at least the first positive amount and the second positive amount.

According to a further aspect of the invention there is provided a computer program that, when run on at least one electronic processor, causes at least: controlling an electromagnetic valve actuator for at least one valve of an internal combustion engine, the electromagnetic valve actuator comprising: a rotor; a stator for rotating the rotor; mechanical energy storage means arranged to store energy in dependence on rotation of the rotor and release the energy to assist rotation of the rotor, wherein the mechanical energy storage means comprises control means to control the amount of energy stored in the mechanical energy storage means by the end of a period of rotation of the rotor in a first direction, between a first positive amount and a second positive amount, such that: the control means is caused to control the amount of energy stored in the mechanical energy storage means by the end of a period of rotation of the rotor in a first direction, between at least the first positive amount and the second positive amount.

According to a further aspect of the invention there is provided a non-transitory tangible physical entity embodying a computer program comprising computer program instructions that, when executed by at least one electronic processor, enable a controller at least to perform any one or more of the methods described herein.

According to a further aspect of the invention the mechanical energy storage means as described above is not necessarily mechanical but could be any energy storage means, e.g. electrical or chemical.

It will be appreciated that the various techniques of phase variation, energy release flank and energy storage control may be combined.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which:

FIG. 3 illustrates an example of an electromagnetic valve actuator, a mechanism and a poppet valve;

DETAILED DESCRIPTION

Figure 1:
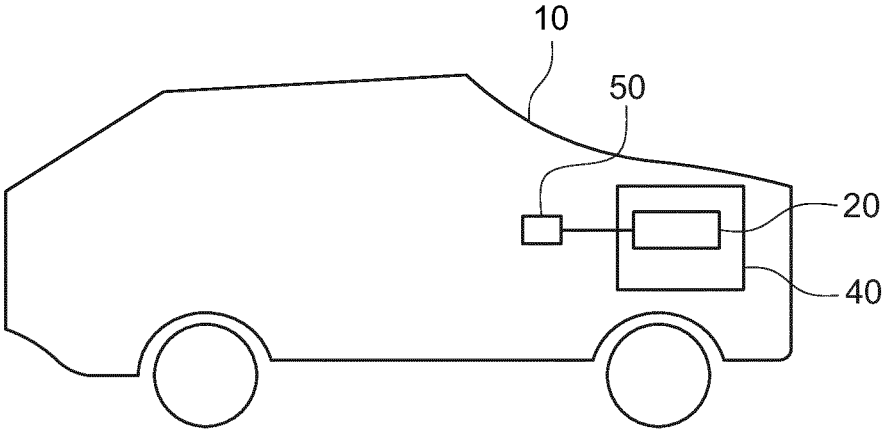
FIG. 1 illustrates an example of a vehicle.

FIG. 1 illustrates an example of a vehicle 10 in which embodiments of the invention can be implemented. In some, but not necessarily all examples, the vehicle 10 is a passenger vehicle, also referred to as a passenger car or as an automobile. Passenger vehicles generally have kerb weights of less than 5000 kg. In other examples, embodiments of the invention can be implemented for other applications, such as industrial vehicles, air or marine vehicles.

The vehicle 10 comprises an internal combustion engine ('engine') 40. The engine comprises a valvetrain 20. The valvetrain 20 comprises the EVA 100 (not shown in FIG. 1) embodying one or more aspects of the invention.

Figure 2A:
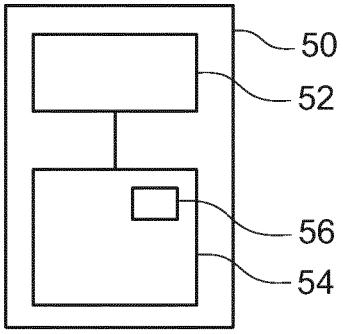
FIG. 2A illustrates an example of a controller and FIG. 2B illustrates an example of a computer-readable storage medium.

The vehicle 10 comprises a controller 50. An example implementation of the controller 50 is shown in FIG. 2A. The controller 50 may consist of a single discrete control unit such as shown in FIG. 2A and described below, or its functionality may be distributed over a plurality of such control units. The controller 50 may comprise an engine control unit and/or a dedicated valvetrain control unit and/or any other appropriate control unit(s). The controller 50 and EVA 100 may together define a valve actuation system when together.

The controller 50 includes at least one electronic processor 52; and at least one electronic memory device 54 electrically coupled to the electronic processor and having instructions 56 (e.g. a computer program) stored therein, the at least one electronic memory device and the instructions configured to, with the at least one electronic processor, cause any one or more of the methods described herein to be performed.

Figure 2B:
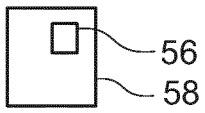

FIG. 2B illustrates an example of a non-transitory computer-readable storage medium 58 comprising the computer program 56.

An example design of the EVA 100 is now described, with reference to FIG. 3. Although the phase varying means, asymmetry of the cams means, and specific aspects of the control means are not shown in FIG. 3, an example underlying system to which these means can be applied is shown.

Each EVA 100 may be for actuating a single valve 300 or for actuating a plurality of valves. In an engine 40 having a plurality of combustion chambers, each combustion chamber may be associated with one or more valves for allowing gas exchange to/from the combustion chamber, EVAs may be provided for at least one of the one or more valves. Therefore, the valvetrain 20 may comprise a plurality of EVAs.

Depending on implementation, EVAs may be provided for intake valves, for exhaust valves, or for a combination thereof.

The EVA 100 comprises an electric machine comprising a rotor-stator pair. Energy to the stator 101 can be supplied from any appropriate known energy source on the vehicle 10 such as a battery or the engine. The energy may be supplied via an alternator or inverter.

The rotor 102 opens the valve 300 via any appropriate means. In FIG. 3 the rotor 102 comprises output means comprising an opening lobe 104. The opening lobe 104 may be coupled to the valve 300 via any appropriate mechanism 200 such as a conventional tappet. In FIG. 3 the mechanism 200 is more complex than a conventional tappet. The mechanism 200 comprises an upper rocker 202, 204 and a lower rocker 208 coupled to each other by a pushrod 206. Valve movement may be amplified relative to the lift of the opening lobe 104 by a multiple within the range 1.3 to 1.95. This range of mechanical advantage is for optimized tolerances, power consumption and system packaging. The EVA 100, mechanism 200 and valve 300 when supplied together may define a system.

The force required to close the valve 300 can be provided by a valve return spring (not shown) and/or by configuring the EVA 100 for desmodromic operation. In FIG. 3, the EVA 100 is configured for desmodromic operation. In FIG. 3, but not necessarily in all examples, the output means comprises a closing lobe 106. The opening lobe 104 actuates a clockwise portion 202 of the upper rocker (clockwise from perspective of FIG. 3) and the closing lobe 106 actuates a counter-clockwise portion 204 of the upper rocker. The rocker 202, 204 pushes and pulls the pushrod 206. The pushrod 206 causes the lower rocker 208 to push and pull the stem of the valve 300. The lower rocker 208 grips the valve 300 like a claw to enable both opening and closing.

The stator 101 can apply positive and negative torque to accelerate and decelerate the rotor 102 and reverse its direction of rotation. The nominal output of the stator 101 may be capable of supplying up to Y Nm of torque for rotating the rotor 102. In one implementation, Y may be from the range approximately 0.5 Nm to approximately 1.5 Nm. The valve lift events that can be achieved is limited by the speed/acceleration/jerk of the rotor which is limited by Y and the derivative(s) of Y.

To plan valve lift events and control stator current accordingly, the controller 50 may receive information indicative of one or more required properties of one or more upcoming valve lift events, such as valve opening time, peak valve lift, and valve closing time. The controller may determine a target rotor velocity (angular velocity) for achieving the valve lift curve. A relationship between target rotor velocity and stator current is stored in the controller 50. The stator current is determined and an output signal is transmitted which causes any appropriate power electronics to control the stator current. The controller 50 may be equipped to control stator current in various engine operating scenarios, including one or more of:

- Perform a full valve lift event by rotating the rotor 102 in a first direction for the valve opening stage and continuing rotation in the first direction for the valve closing stage.
- Perform a partial valve lift event by rotating the rotor 102 in a first direction for the valve opening stage and in a second, opposite direction for the valve closing stage. The reversal occurs when a target peak lift less than the maximum peak valve lift is reached. The reversal requires negative stator current.
- Perform a skewed full or partial valve lift event wherein the target rotor velocity in the valve closing stage is different from the target rotor velocity in the valve opening stage.
- Perform multiple valve lifts in one stage of a combustion cycle. For example, the rotor may be rotated twice rather than once. Or, the rotor may be reversed twice or three times.
- 'Park' the rotor 102 between valve lift events at a park position, in which the target rotor velocity is zero.

This requires negative 'braking' torque. The park position may correspond to a detent location for minimal cogging torque, so that little or no energy is required to hold the rotor 102 in the park position. The detent locations are specific to the permanent magnet arrangement of the stator 101.

In one implementation, the size of the stator 101 is constrained by engine bay space. It may be that Y is less than a torque required to fully open the valve 300 at an engine speed above 5000 rpm, e.g. for a gasoline engine. Therefore, the stator 101 may require assistance for achieving one or more of the above-described target rotor velocities. Therefore, as shown in FIG. 3, the EVA 100 comprises a mechanical energy storage means, referred to as ERS (energy recovery system) herein. The nominal output of the ERS may be capable of supplying up to X Nm of torque for rotating the rotor 102, wherein X<Y and wherein X is approximately 80% of Y, or any other value from the range approximately 60% to approximately 95% of Y. Working together, the stator 101 and ERS can supply nearly X+Y torque to the rotor 102. If the stator can be larger, X could be from the broader range approximately 40% to approximately 95% because less assistance is required.

In FIG. 3, but not necessarily in all examples, the ERS is cam/eccentric-actuated. An ERS lobe 108 is shown on the rotor 102. The ERS lobe 108 directly or indirectly couples to a resilient member for storing elastic deformation energy. In FIG. 3 the coupling is via an ERS rocker 110. In FIG. 3, but not necessarily in all examples, the resilient member is a cantilever spring 116 which is deflectable about a fulcrum 118. The stiffness of the cantilever spring 116 can be configured to store elastic potential energy for X Nm of torque assistance when fully actuated by the nose of the ERS lobe 108. No elastic potential energy is stored when on the base circle of the ERS lobe 108. In other examples the resilient member could be a different type of resilient member such as a coil spring or other resiliently deformable component.

The operation of the ERS will now be described, with reference to a typical engine operating scenario. In this scenario, the ERS is charged during valve closing and the energy is released prior to the next valve opening. During the valve opening stage, the contact point between the ERS lobe 108 and the ERS rocker 110 is on the base circle of the ERS lobe 108, so that energy recovery does not commence while the valve 300 is opening. Then, during the valve closing phase the contact point between the ERS lobe 108 and the ERS rocker 110 ascends up a flank of the ERS lobe 108 to bias the cantilever spring 116 away from its equilibrium position. Once peak lift of the ERS lobe 108 is reached, the cantilever spring 116 is fully deflected (ERS fully 'charged'). It may be that the peak lift is aligned with a detent location as described above, so that the ERS is fully charged while the rotor 102 is in a park position. FIG. 3 also shows that the ERS lobe 108 has a substantially flat top which is sufficiently flat to increase stability/reduce wobble. As soon as the rotor 102 starts to move for the next valve lift event, the contact point descends down a flank of the ERS lobe 108. If rotation is in the same direction the flank is the opposite flank from that which was ascended. If rotation is in reverse the flank is the same flank which was ascended. The cantilever spring 116 is no longer forced away from its equilibrium position so releases its energy to accelerate the ERS lobe 108. This accelerates the rotor 102. This extra torque assists the stator 101 in meeting the target rotor velocity for the next valve lift event.

The ERS of FIG. 3 is also space-efficient for various reasons. One of the most significant packaging constraints for engine bays is the height of the EVA 100. The ERS lobe 108 is integrated into the rotor 102 and therefore does not increase the overall height of the system. The ERS rocker 110 is positioned lower than the top of the stator housing 122. The cantilever spring 116 comprises a coupling 120 at one end to the top of the stator housing 122. The axis of the cantilever spring 116 is substantially horizontal. In FIG. 3 the fulcrum 118 is separate from the coupling 120 and located towards the free end of the cantilever spring, but in other examples the fulcrum 118 could be provided by the coupling 120. The fulcrum 118 is above the cantilever spring 116, but the top of the fulcrum 118 is only in the order of tens of millimetres higher than the top of the stator housing 122, for example from the range approximately 10 mm to approximately 20 mm.

Although the above design is space-efficient, it would be appreciated that various aspects of the invention relate to phasing which can be achieved with a different implementation of the ERS and/or EVA 100 from that shown. In other examples the ERS may be implemented with different mechanical components, or even electronically, electromagnetically, hydraulically or pneumatically. Further, although one ERS lobe 108 is shown, more than one could be provided, or none if a different principle of actuation is provided such as a belt, chain or even an electric machine.

The valve actuation techniques described herein involve varying a phase between components of the actuator. In functional terms, the phase between two components may be an offset between the timing at which those components perform their particular functions. For example, the phase between a cam (which charges the ERS) and the rotor 102 defines a timing at which the ERS is charged and released (by the cam) in relation to the timing at which the valve is opened and closed (by the rotor). In this sense, a change in the phase would be a change in the timing offset between the ERS charging and releasing, and the valve opening/closing. It will be appreciated that the timing offset and change in timing offset may be an offset in duration, or an offset in a cycle (for example as a percentage offset of the cycle) where that cycle can be carried out at different rates.

In structural terms, the phase between two components may be an angular or rotational position of one of the two components with respect to the other of the two components with respect to a common axis. For example, the phase between the cam and the rotor 102 may define an angular position of the cam with respect to the rotor 102. Here, a change in phase involves changing the relative angular position between the cam and the rotor 102 about the common axis.

Figure 4A:
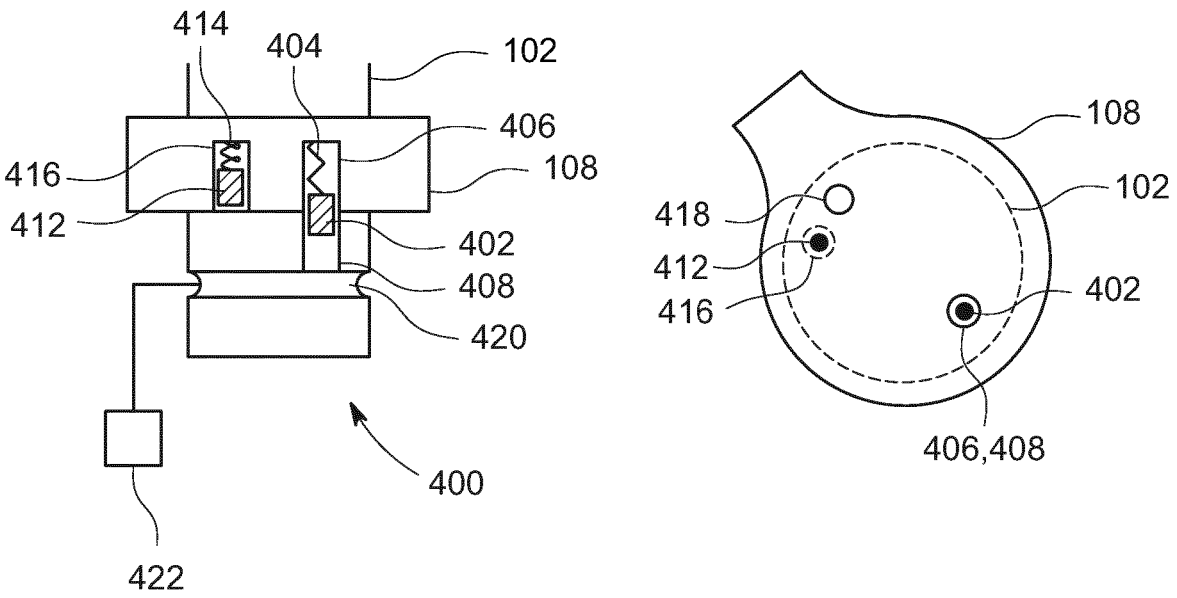
FIG. 4A illustrates an example of phase-varying means set to a first phase.
Figure 4B:
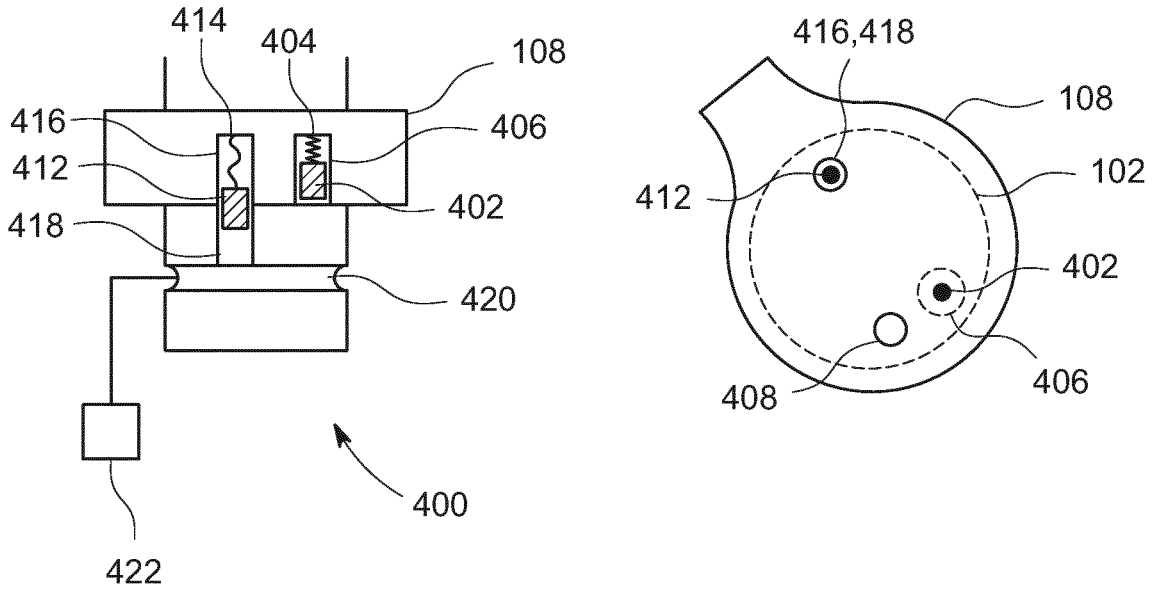
FIG. 4B illustrates an example of phase-varying means set to a second phase.

FIGS. 4A and 4B illustrate an example implementation of phase varying means 400 in which the phase of a cam relative to the rotor 102 can be changed. This changes the phasing of the ERS with respect to valve timing. In FIGS. 4A and 4B, but not necessarily in all examples, the phase of the ERS lobe 108 can be changed relative to the output means, wherein the output means are permanently fixed to the rotor 102. For example, the phase of the ERS lobe 108 is changeable relative to the opening lobe 104 and/or the closing lobe 106. In other examples, the phase of the output means can be changed relative to the ERS lobe 108 or the rotor 102.

The ERS lobe 108 is not formed or otherwise permanently fixed to the rotor 102. The ERS lobe 108 is capable of 'floating' on the rotor 102, removing or reducing a relationship between rotation of the rotor 102 and rotation of the ERS lobe 108. At two or more phase positions relative to the rotor 102, the ERS lobe 108 is attachable (can be fixed) to the rotor 102 to lock the phase between the rotor 102 and the ERS lobe 108.

FIGS. 4A and 4B show a hydraulically-actuated two-pin system. The rotor 102 comprises a hydraulic fluid groove 420. The hydraulic fluid could be engine oil or another fluid. In one implementation, the open face of the groove is covered by a bearing housing (not shown), such that fluid in the groove cannot readily escape. Fluid can be supplied to the groove via an aperture in the bearing housing. The pressure of the fluid can be controlled using a solenoid 422. Other known means of supplying hydraulic fluid are also usable.

Radial drillings in the groove transport fluid into passageways inside the rotor 102. Each passageway extends into (or defines) a rotor chamber 408, 418. Two rotor chambers 408, 418 are shown. The pair of rotor chambers 408, 418 are rotationally offset with respect to the axis of rotation of the rotor, by a fixed amount. Corresponding lobe chambers 406, 416 are also provided in the ERS lobe 108. The pair of lobe chambers 406, 416 are rotationally offset by a fixed amount which is different from the rotor chamber offset. For example, the offset may differ by 10 to 30 degrees. Therefore, it is not possible for both lobe chambers 406, 416 to align with both rotor chambers 408, 418 at once.

A locking pin 402, 412 is in each lobe chamber. As shown in FIG. 4A, when a first locking pin 402 extends into both a first rotor chamber 408 and a first lobe chamber 406, the locking pin 402 is in an interference position so the rotor 102 and ERS lobe 108 are locked together. This defines a first phase. As shown in FIG. 4B, when a second locking pin 412 extends into both a second rotor chamber 418 and a second lobe chamber 416, the second locking pin 412 is in an interference position so the rotor 102 and ERS lobe 108 are locked together. This defines a second phase.

The locking pins 402, 412 are biased towards the respective rotor chambers 408, 418 by respective springs 404, 414. When a rotor chamber is aligned with a lobe chamber, the locking pin 402, 412 will move to its interference position if hydraulic pressure is low. Raising hydraulic pressure pushes against the spring 404, 414 so that the locking pin 402, 412 is pushed back into the lobe chamber 406, 416 to unlock the ERS lobe 108. To change phase according to the above design, hydraulic pressure within the groove 420 can be increased to detach the ERS lobe 108, and then reduced at a calculated time to re-attach the ERS lobe 108 at the desired phase.

The above implementation is based on raising fluid pressure to unlock. In an alternative implementation, the design is based on lowering fluid pressure to unlock, so constant raised hydraulic pressure is required to maintain the locking pin in the interference position.

In another implementation, the locking pin 402, 412 could be retracted into the rotor chamber rather than the lobe chamber, with corresponding changes to the fluid supply routing.

Although the groove 420 is shown on one side of the ERS lobe 108, it could be on the other side of the ERS lobe 108 in another implementation, with the grooves, pins and springs mirrored.

The above implementation is a two-pin design. However, it is possible to change phase using a one-pin two-chamber design in another implementation. This would require one locking pin 402 in one rotor chamber 408 and at least two lobe chambers 406, 416, or one locking pin 402 in one lobe chamber 406 and at least two rotor chambers 408, 418. When the chamber in which the locking pin 402 is located aligns with one of the corresponding other chambers, the pin can be slid into the interference position by control of hydraulic pressure. When the ERS lobe 108 is detached, then once the pin 402 aligns with the next one of the corresponding other chambers, the pin can again be slid into the interference position if hydraulic pressure is high, and the phase will have been varied depending on the rotational separation of the other chambers relative to each other.

The above principles can readily be applied to a phase varying means with three or more phases, simply by increasing the number of rotationally offset interference positions.

The actuating means described above is hydraulic fluid although other actuating means are also envisaged based on electromagnetics or pneumatics.

In another variation, the attachment of the ERS lobe 108 could be controlled in a different way than by applying hydraulic pressure. For example, the locking pin could have a sloped surface, and be spring biased as disclosed above. When in the interference position, the rotor 102 and ERS lobe 108 could couple at a contact point on the sloped surface. The slope is against the direction of rotation so that acceleration of the rotor 'drags' the ERS lobe 108 with it. Shear force between the ERS lobe 108 and the rotor 102 acts on the contact point on the sloped surface, to lock their speeds together. When shear force is increased by applying a force to slow the ERS lobe 108 relative to the rotor 102, the forces on the contact point are no longer in equilibrium so the locking pin 402 starts to compress the spring 404 and retract away from the interference position. With sufficient shear force, the ERS lobe 108 is unlocked. An advantage is enabling a 'dry' system, because shear force could be controlled by electromagnetic means such as a small electric actuator proximal to or inside the rotor 102 or ERS lobe 108 that controls an electric/magnetic field. Variable cam timing systems exist which work on a similar premise.

A locking pin design is one of many alternative ways in which the phase varying means can be implemented. In another example, no locking pins are involved. For example, the ERS rocker 110 could be actuated to change the phasing between the ERS lobe 108 and the cantilever spring 116.

In view of the above, it would be appreciated that the phase varying means can be implemented in many ways.

Methods of using the phase varying means will now be explained, with reference to FIGS. 5 to 7.

Figure 5:
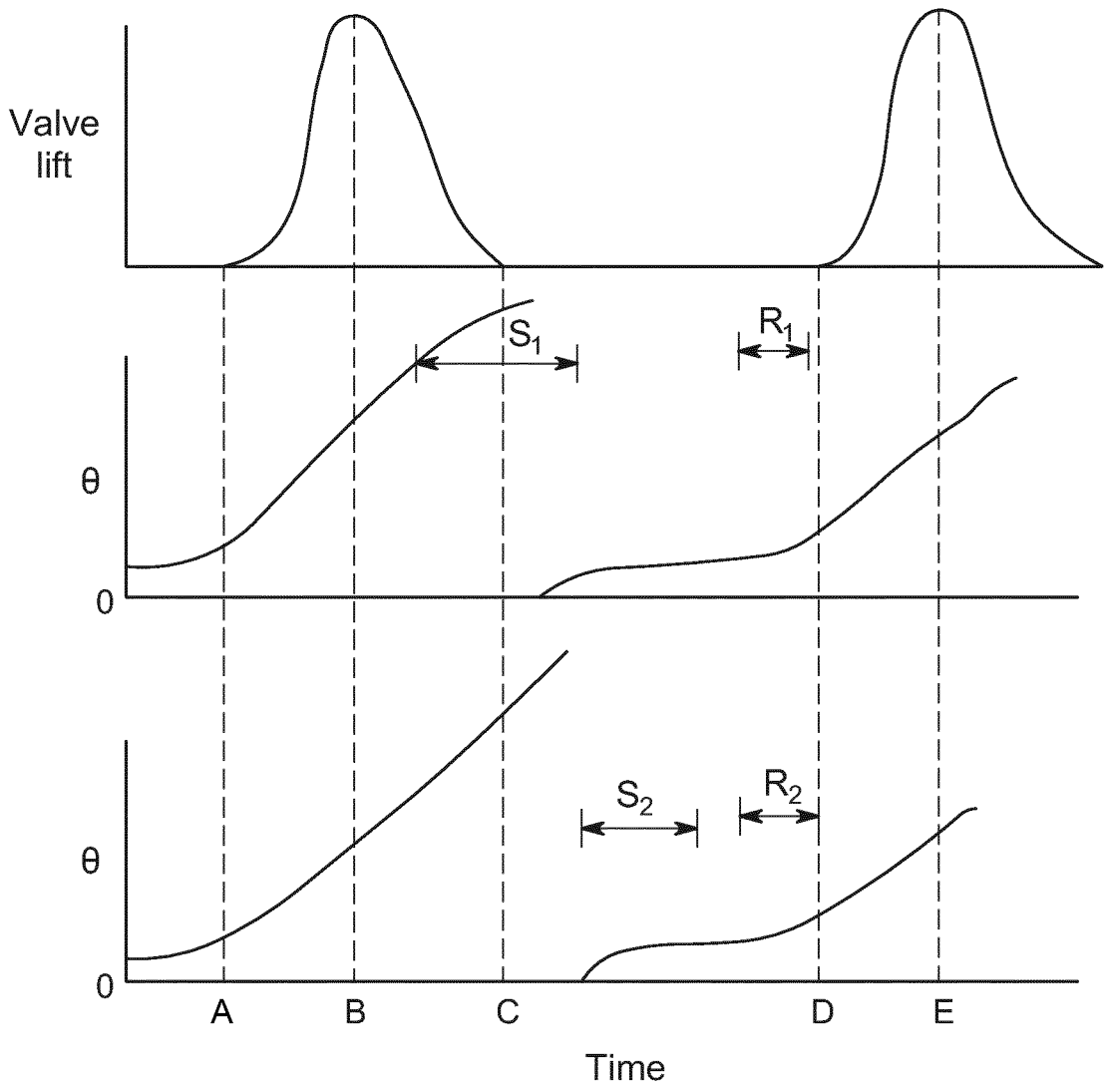
FIG. 5 illustrates valve lift and rotor angle according to an example use case.
Figure 6:
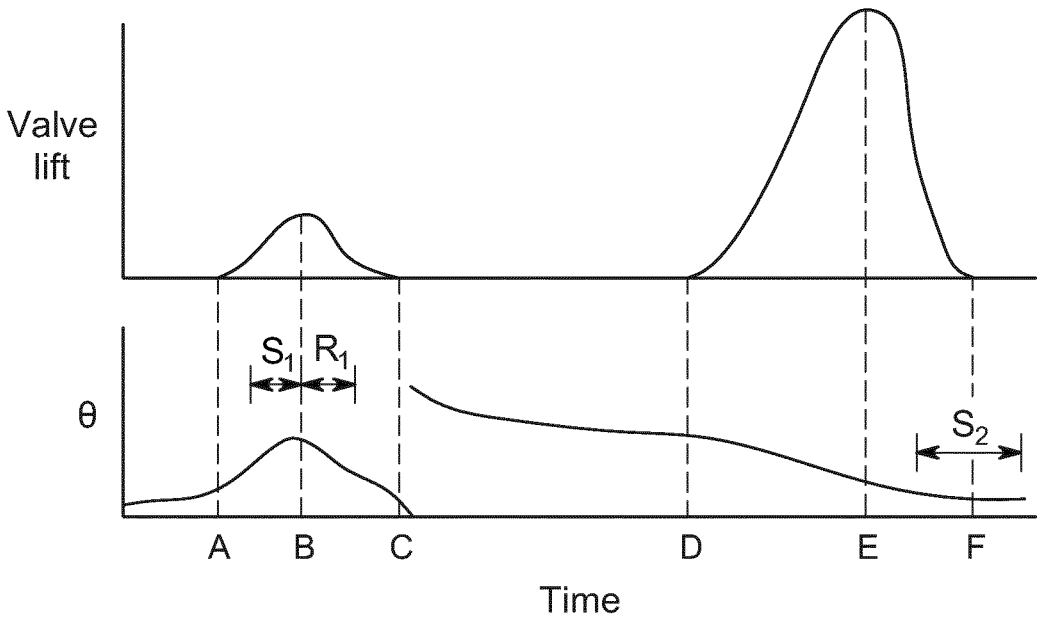
FIG. 6 illustrates valve lift and rotor angle according to an example use case.
Figure 7:
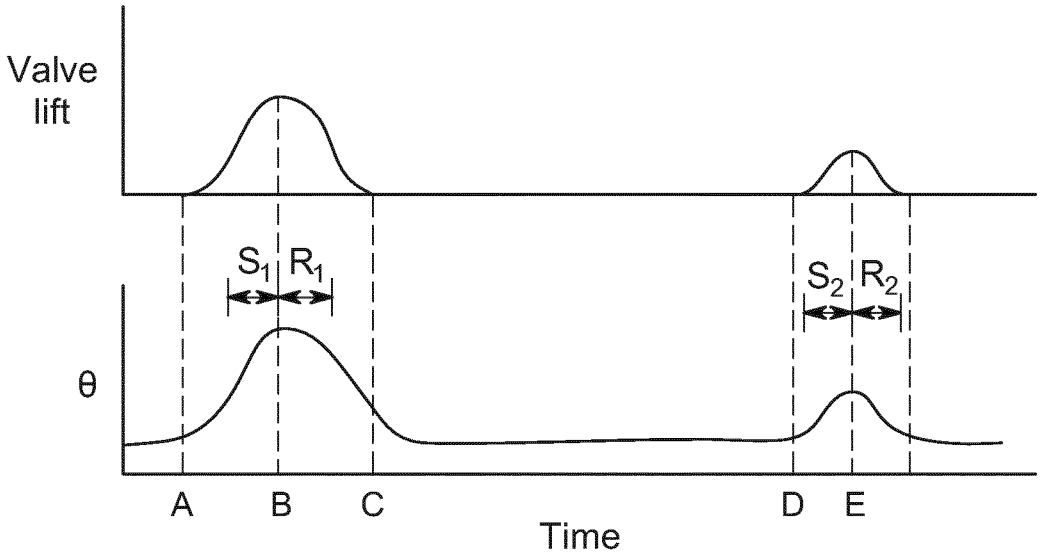
FIG. 7 illustrates valve lift and rotor angle according to an example use case.

Each of FIGS. 5 to 7 illustrates a top graph which shows valve lift (vertical, y-axis) against a time domain (horizontal, x-axis). The time domain is degrees of crank rotation. One or more lower graphs shows rotor angular position (θ, y-axis) against the same time domain.

FIG. 5 relates to the first example operating scenario as described earlier. FIG. 7 relates to the second example operating scenario. FIG. 6 relates to changing between the second scenario and the first scenario. The controller 50 is configured to control the phase in the manner described below in relation to one or more of the operating scenarios.

The upper graph of FIG. 5 shows two valve lift events.

The middle graph of FIG. 5 shows rotor position for 'phase 1' of the phase varying means. Before time A the rotor 102 is in its park position. The ERS is fully charged. At time A the valve 300 starts to open. At time B the valve 300 reaches its maximum peak lift. Between times A and B the contact point between the ERS lobe 108 and the ERS rocker 110 is on the base circle of the ERS lobe 108. At time C the valve 300 is fully closed. Between times B and C the ERS starts to charge. Referring to the hardware example of FIG. 3, the ERS lobe 108 starts to deflect the cantilever spring 116. The optimum start time for ERS charging is denoted by the region 'S1' which is between time B and time C, or between time B and after time C. The effect of charging the ERS is illustrated by the visible slowdown of the rotor 102. The rotor 102 slows to a halt at or after time C. The ERS may be fully charged when the rotor 102 is stationary. If the energy recovery is insufficient the stator 101 may assist the charging of the ERS. The rotor 102 halts at a park position which may be aligned with a detent. The rotor 102 remains in the park position until a required time before time D. Time D represents the valve 300 starting to open for a subsequent valve lift event. The rotor 102 begins to rotate with the assistance of the ERS, before time D, in the region R1. The region R1 occurs at a predetermined time between S1 and time D. The target rotor velocity for valve opening at time D is therefore achieved with assistance from the ERS. After time E (target peak lift), the ERS may charge again.

The lowest graph of FIG. 5 shows rotor position for 'phase 2' of the phase varying means. The phase may be changed in advance, between valve lift events. Stator torque may be supplied to slide the rotor 102 relative to the ERS lobe 108 into the next phase position, if the change occurs while the rotor 102 is in a park position. The ERS is retarded relative to phase 1. Now, ERS charging denoted by region S2 commences after time C, not before. Energy release denoted by region R2 commences before time D, and may or may not be timed to occur at the same time as region R1.

As explained earlier, switching from phase 1 to phase 2 may be performed in response to a parameter indicative of kinetic energy, such as rotor velocity or engine speed, indicating insufficient kinetic energy (inertia) to fully charge the ERS without assistance by the stator 101. Additionally or alternatively, the switch may be performed for another reason such as in response to a determination that the rotor 102 must speed up between times B and C (fast valve close event), or in response to satisfaction of a safety/limp mode condition or other condition.

FIG. 7 will be described before FIG. 6. The upper graph of FIG. 7 illustrates two partial valve lift events, requiring reversal of the direction of rotation of the rotor 102. At time A the valve 300 starts to open. Between times A and B the rotor 102 needs to decelerate to a halt so that a reversal of rotation occurs at time B (target peak lift). The controller 50 determines when the ERS should commence charging and selects an appropriate ERS phase, to minimise a requirement for the stator 101 to apply negative torque. The ERS at phase 1 charges in the region S1 between times A and B, which decelerates the rotor 102. At time B the rotor 102 ceases rotation and the target peak valve lift is achieved. The contact point between the ERS lobe 108 and the ERS rocker 110 may still be on the flank rather than on the nose of the ERS lobe 108, to reduce the chance of an overshoot. From time B the rotor 102 reverses direction and the contact point between the ERS lobe 108 and the ERS rocker 110 descends the same flank towards base circle. This energy release in region R1 minimises a requirement for the stator 101 to accelerate the rotor 102 in the reverse direction.

At time C of FIG. 7 the valve 300 closes. In FIG. 7 the stator 101 then stops the rotor 102 in a park position between times C and D in preparation for the next valve lift event. However, in other examples the rotor 102 could continually rotate or the reverse rotation may even become its forward direction of rotation for the next valve lift event. An event planning function in the controller 50 may determine that the next valve lift event is also a partial valve lift event and plan the rotor 102 behaviour accordingly between times C and D. If the next valve lift event requires a different amount of lift, a different ERS phase may be selected to minimise the requirement for negative stator torque. The phase may be changed between times C and D. Stator energy may be supplied to facilitate the change, if the change occurs once the rotor 102 has already stopped rotating. For example, FIG. 7 shows that less lift is required for the next valve lift event. As a result, the ERS charging occurs in the region S2 which is slightly later than the region S1, so that the point of reversal is aligned with time D (beginning of valve opening phase) without the need for additional stator energy. There may be some scenarios in which ERS charging should be advanced when less lift is required, such as when the target rotor velocity is higher.

FIG. 6 shows a transition from a partial valve lift such as shown in FIG. 7 and a full valve lift such as shown in FIG. 5. Between times A to C the ERS phase performs the function of phase 1 (or phase 2) of FIG. 7, with charging at S1 and release at R1. Between times D and E the ERS phase should perform the function of phase 1 or 2 of FIG. 5. An efficient control strategy is to allow the rotor 102 to continue rotating between times C and D in the reverse direction, such that the reverse direction becomes the forward direction for the next valve lift event from times D to E. The ERS phase is changed in advance between times C and D. The charging S2 for phase 2 occurs during the closing phase of the next valve lift event from times E to F, wherein at time F the valve 300 is fully closed. Therefore, S2 occurs later with respect to the respective valve lift event than S1.

Figure 8:
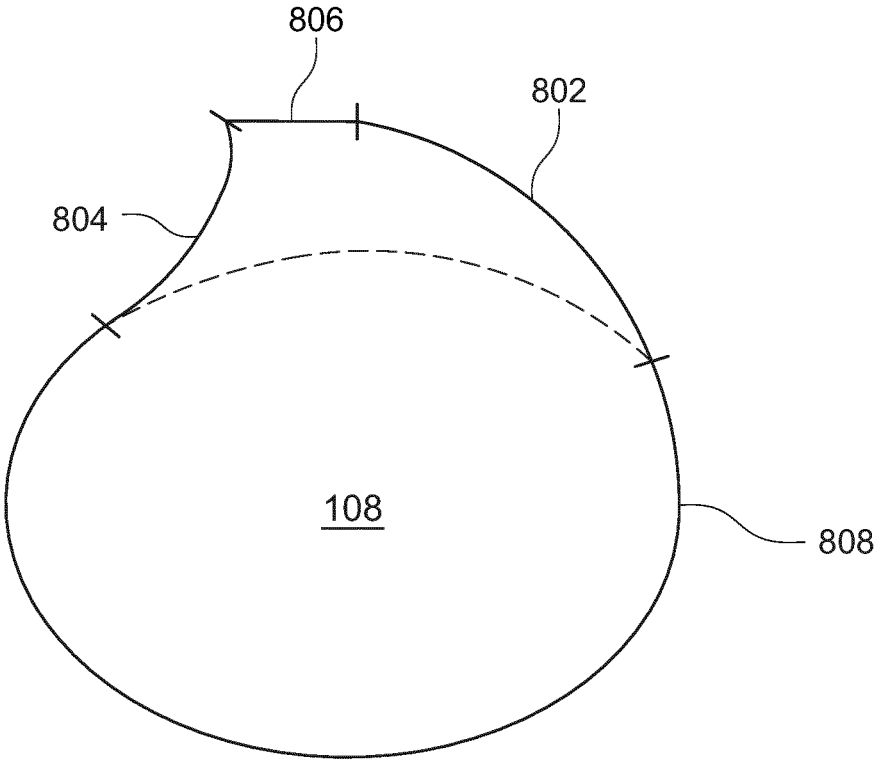
FIG. 8 illustrates an example of asymmetric cam means.

According to an aspect of the invention, the ERS lobe 108 is the cam means having an asymmetric profile. FIG. 8 illustrates an example of the asymmetric profile.

The ERS lobe 108 comprises an energy storage flank 802 for enabling the ERS to store energy. The ERS lobe 108 comprises an energy release flank 804 for enabling the ERS to release the energy. When the ERS lobe 108 is rotated in a 'default' direction (for example clockwise in FIG. 8) and performs a full rotation, the flank 802 charges the ERS. In some operating scenarios, the ERS lobe 108 may be operated in reverse such that the functions of the flanks 802 and 804 are reversed. Or, the ERS may be charged in the default direction and discharged in reverse, so one flank 802 or 804 performs both the energy storage and release functions. However, the flank 802 is for storage and the flank 804 is for release, when a default full valve lift event is scheduled.

FIG. 8 also shows the optional substantially flat top 806, wherein this flatter lobe nose increases stability while the ERS is charged. The flatter lobe noses increases stability because, when the contact point between the ERS lobe 108 and ERS rocker 110 coincides with the flat top 806, the inwardly directed force provided by the spring bias does not induce rotation, and in fact slightly opposes it.

The asymmetric profile comprises the energy storage flank having a different profile from the energy release flank. In FIG. 8, but not necessarily in all examples, the asymmetric profile comprises the energy storage flank having a lower average steepness than the energy release flank. This is achieved in FIG. 8 by the length of the energy storage flank 802 being longer than the length of the energy release flank 804. Since the lift of the energy storage flank 802 relative to the base circle 808 is the same as the lift of the energy release flank 804 relative to the base circle 808, the increased length of the energy storage flank 802 gives the energy storage flank 802 its lower steepness.

Steepness could be expressed in terms of distance per radian, for example. Distance represents the lift of the flank relative to the base circle 808, and radians represents a unit of angular change. Further, the lower steepness is a lower average steepness. The energy storage flank 802 could have a complex geometry such that some sections of the energy storage flank 802 have a higher instantaneous steepness than a section of the energy release flank 804, wherein the average steepness is still lower. In some examples, the steepness at any arbitrary point along the energy storage flank 802 is lower than the average steepness of the energy release flank 804. In some examples, the steepness at any arbitrary point along the energy storage flank 802 is lower than the steepness at any arbitrary point along the energy release flank 804.

This asymmetry can be utilised in various useful ways by a controller 50 planning valve lift events. For example, the controller 50 may be configured to provide torque for desmodromically closing the valve during a valve closing phase. This torque may be required for accelerating the rotor 102 to achieve a higher target rotor velocity in the valve closing phase than in the valve opening phase. The controller 50 may also be configured to provide the assistive torque needed to cause the stator to provide assistive torque to reach the ERS lobe nose, when the inertia is insufficient to charge the ERS. This assistance may be required at the same time as the higher target rotor velocity in the valve closing phase is required, depending on the phasing of the ERS lobe 108 relative to the output means. Without the asymmetry, the target rotor velocity for the valve closing phase may be low so that enough stator torque capacity is left to provide the assistive torque. Taking into account the asymmetry, the controller may be programmed so that the maximum available target rotor velocity for the valve closing phase is higher than would otherwise be possible for a system without the asymmetric cam means.

During release of energy from the mechanical energy storage means, the controller 50 may be configured to cause the stator 101 to apply a small amount of negative torque for slightly braking the descent of the energy release flank 804, therefore ensuring continuous contact between the energy release flank 804 and the ERS rocker 110.

Another way in which the asymmetry could be utilised is in planning whether to rotate the rotor 102 forward or in reverse. This could take into account the timing of the valve opening time and the valve closing time, to determine whether a short ramp (flank 804) or a long ramp (flank 802) is most efficient for acceleration or deceleration. For a partial valve lift event, the controller 50 could determine in which direction to rotate the rotor 102, based on whether the long ramp (flank 802) or the short ramp (flank 804) best achieves a target valve lift profile and/or is most efficient. For example, reversing the rotation of the rotor using the long ramp results in a flatter-topped valve lift profile, wherein the valve 300 remains at its target peak lift for longer. Reversing the rotation of the rotor using the short ramp results in a sharper-topped valve lift profile. The short ramp may be used below an engine-speed threshold and the long ramp above the threshold, the direction of rotation may be controlled such that the long ramp may be used for energy storage and the short ramp used for energy release, if rotor velocity for a preceding or later valve lift event is above a threshold.

Figure 9:
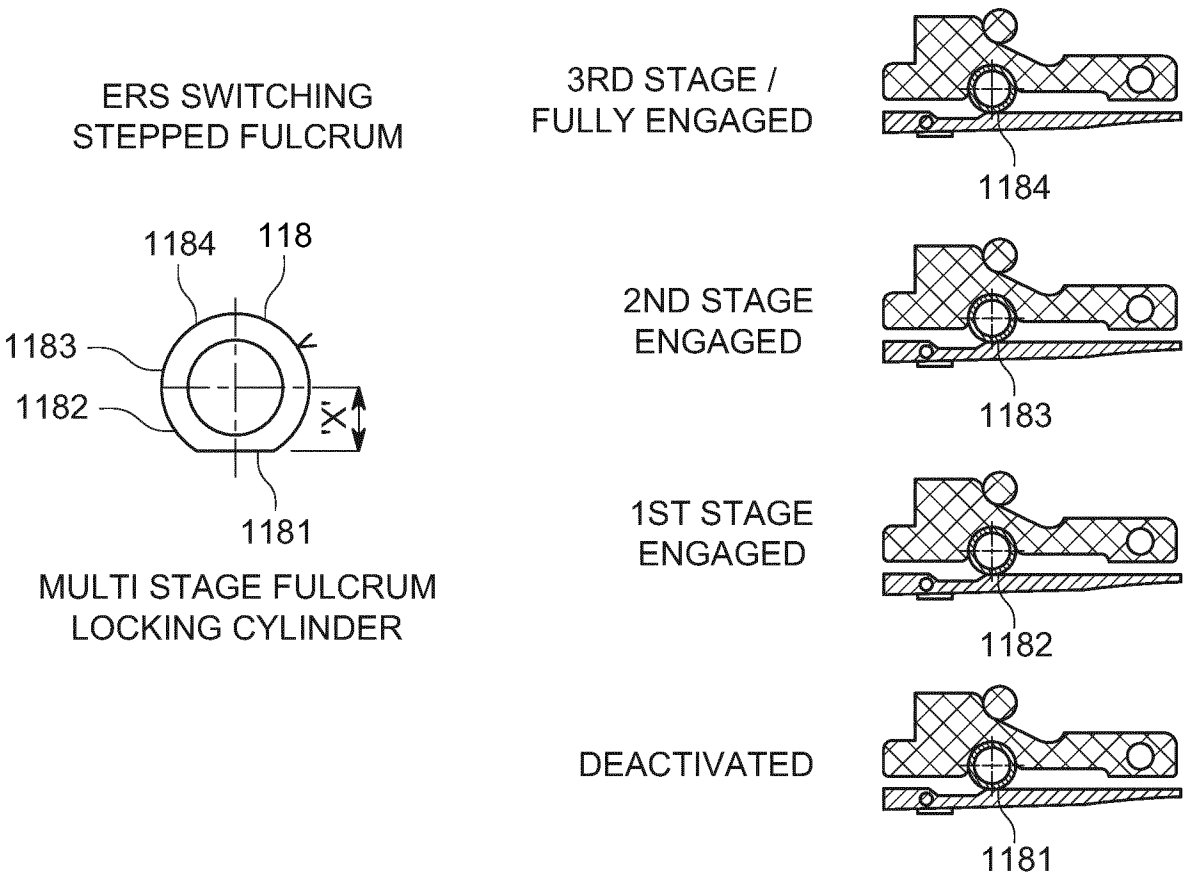
FIG. 9 illustrates an example of staging means.

FIG. 9 relates to the first example implementation discussed earlier. FIG. 9 is an illustration of the principle of staging means for controlling staged actuation of the ERS, and a possible implementation.

The implementation of FIG. 9 relies on an active fulcrum. The active fulcrum in FIG. 9 is a cylinder configured to be actuated (rotated). While referred to herein as a cylinder, it should be understood that the active fulcrum is only generally cylindrical, since it does not have a uniform cross section. The fulcrum 118 and the cantilever spring 116 are in contact at a contact point preferably at all times. To maintain contact between the fulcrum 118 and the cantilever spring 116, the ERS rocker 110 may be permanently biased against the underside of the cantilever spring 116, for example at a position distal from the pivot point of the cantilever spring 116. For the embodiment of FIG. 9 the contact point between the fulcrum 118 and the cantilever spring 116 remains at substantially the same position along the length of the cantilever spring 116, although in other embodiments (see for example FIG. 11) the contact point moves along the cantilever spring 116. The fulcrum 118 is rotatable about an axis of rotation in a manner which varies (with angular position) the distance between the axis of rotation and the contact point. In some embodiments, for at least one position of the fulcrum 118, a gap exists between the ERS lobe 108 and the ERS rocker 110 when the ERS rocker 110 is aligned with (but not in contact with) the base circle of the ERS lobe 108. The size of this gap is controlled to vary the duration of a lost motion stage during which the cantilever spring 116 is not deflected and no energy is stored therein. In FIG. 9, but not necessarily in all examples, the size of the gap is controlled by rotating the fulcrum 118 using an actuator (not shown) from a first stage (position) in which the contact point between the fulcrum 118 and the cantilever spring 116 is at a first distance from the axis of rotation of the fulcrum 118, to a second stage (position) in which the contact point is at a second different distance from the axis of rotation. Each stage is defined as a different distance between the contact point and the axis of rotation.

The illustrated active fulcrum has four stages, but more or fewer stages could be provided in other implementations. When the fulcrum 118 is in a first deactivated stage (deactivated position), the gap between the ERS rocker 110 and the ERS lobe 108 is such that even when the cantilever spring 116 is deflected to its maximum extent (nose of ERS lobe 108 contacts ERS rocker 110), the cantilever spring 116 does not deform about the fulcrum 118. The cantilever spring 116 is physically deflected but its connection to the stator housing allows free rotation, so the spring 116 is not resiliently deformed away from its neutral equilibrium position. Consequently no elastic potential energy is stored in the cantilever spring 116.

In a first activated stage ('1st stage' in FIG. 9), the gap between the ERS lobe 108 and the ERS rocker 110 (when the ERS rocker 110 is aligned with the base circle of the ERS lobe 108) is smaller than in the first deactivated stage such that the ERS lobe 108 exerts a force on the cantilever spring 116 (via the ERS rocker 110) before the cantilever spring 116 is deflected to its maximum extent. In other words, the duration of the lost motion stage is reduced. Subsequent deflection of the cantilever spring 116 to the maximum extent stores elastic potential energy.

In a second activated stage ('2nd stage' in FIG. 9), the gap between the ERS lobe 108 and the ERS rocker 110 (when the ERS rocker 110 is aligned with the base circle of the ERS lobe 108) is smaller than in the first activated stage. The duration of the lost motion stage is further reduced, and the amount of elastic potential energy stored increases further.

In a third activated stage ('3rd stage' in FIG. 9), the gap is smaller than in the second activated stage or is eliminated. The duration of the lost motion stage is further reduced or lost motion is eliminated. The third stage may be the final 'fully engaged' stage, for which lost motion is reduced to substantially zero, i.e. within manufacturing tolerances. This provides the maximum amount of stored elastic potential energy.

The third activated stage is most suitable for when inertia is high, such as when rotor velocity is high, e.g. engine speed is high (>6000 rpm). The first activated stage is most suitable for when inertia is low, such as when rotor velocity/engine speed is low (e.g. engine speed <3000 rpm). The intermediate first and second stages enable fine tuning for intermediate rotor velocities/engine speeds. The controller 50 can implement the required stage in dependence on a parameter such as rotor velocity or engine speed. Rotor velocity is engine speed dependent when not normalised by crankshaft rotation. Threshold engine speeds could be defined in the controller 50 for switching from one stage to the next. For example, the active fulcrum 118 could be controlled to increase the quantity of energy stored when a parameter such as engine speed increases above a threshold, such as by increasing the amount of lost motion. The amount of lost motion could be decreased when the parameter falls, for example when the parameter falls below the threshold or another threshold.

The fulcrum 118 of FIG. 9 is rotated by a rotary actuator (not shown). The fulcrum 118 is a cylinder having an asymmetric/irregular surface, i.e. variable lift positions corresponding to different radii. The fulcrum 118 of FIG. 9 has: a first (smallest) cross-sectional radius 1181 for enabling the deactivated stage; a second larger cross-sectional radius 1182 for enabling the first stage; a third larger cross-sectional radius 1183 for enabling the second stage; and a fourth largest cross-sectional radius 1184 for enabling the third stage.

Although FIG. 9 illustrates rotary actuation, it would be appreciated that the fulcrum 118 could alternatively be controlled by linear actuation or any other appropriate form of actuation.

Although FIG. 9 illustrates an example in which there are provided various different lost motion stages, it would be appreciated that in another variation, there may be no lost motion. For example the staging means could be deformable to a different extent in each stage, without introducing lost motion. In another variation, there could be another variable gap in the mechanical energy storage means, instead of the gap between the ERS lobe 108 and the ERS rocker 110.

Figure 10:
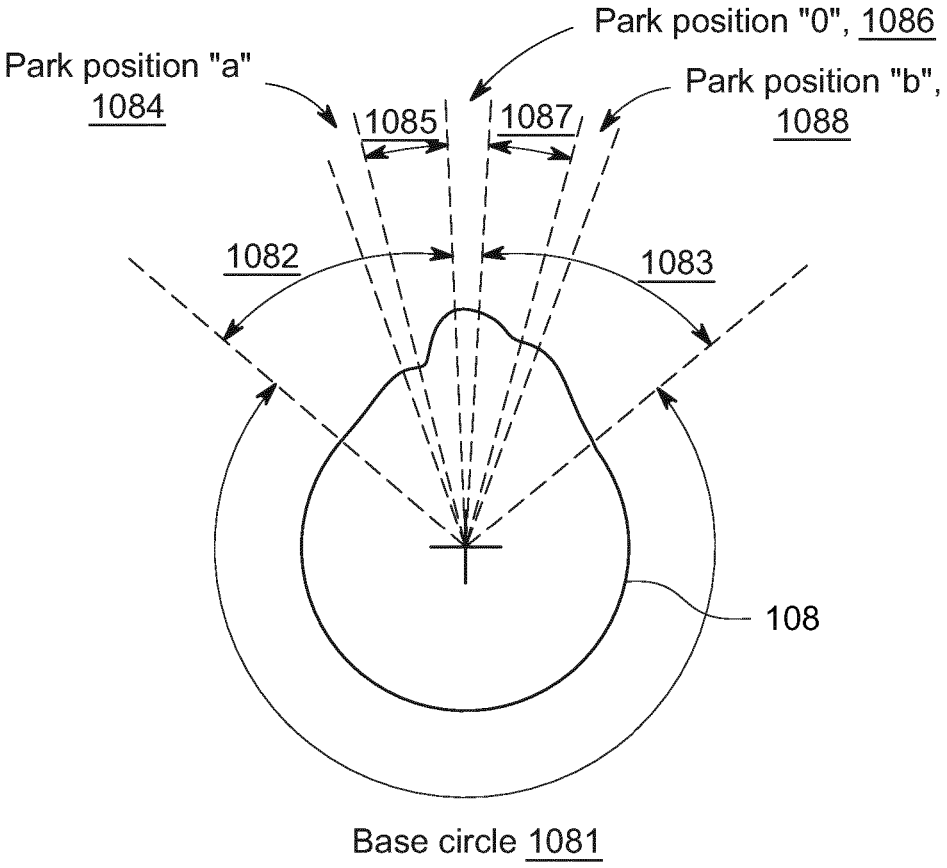
FIG. 10 illustrates an example of cam means with a staged profile.

FIG. 10 relates to the third example implementation discussed earlier. FIG. 10 is an illustration of the principle of a cam means such as the ERS lobe 108 having a staged profile. The staged profile can enable intermediate 'park' positions in which little to no stator energy is required to keep the rotor stationary.

FIG. 10 illustrates plateaus 1084, 1088 in the ERS lobe 108, each plateau providing a park position. The ERS lobe 108 can therefore be 'climbed' up from one stage (park position) to the next, or can be climbed up to a lower stage.

A first plateau 1084 is provided on a first flank 1082 of the ERS lobe 108. The first plateau 1084 enables a first park position labelled 'a' in FIG. 10. Park position a requires the least amount of energy to be input into the cantilever spring 116 to reach the position, because the position is the closest to the base circle 1081 out of all the positions.

The nose 1086 of the ERS lobe 108 defines a second park position on the lobe, labelled '0' because it could represent a default. As described earlier, the nose 1086 can define a substantially flat top to increase stability. The second park position requires the most amount of energy to be input into the cantilever spring 116 to reach the position, because the position is furthest from the base circle 1081 out of all the positions.

A third plateau 1088 is provided, which is on a second flank 1083 of the ERS lobe 108 and labelled 'b'. In other examples the third plateau 1088 is on the first flank 1082. The third plateau 1088 requires more energy to be input into the cantilever spring 116 than the first plateau 1084, because the position is further from the base circle 1081 than the first plateau 1084. However, the third plateau 1088 requires less energy to be input into the cantilever spring 116 to reach the position than the second park position at the nose 1086.

Park position 0 is most suitable for when inertia is high such as when rotor velocity/engine speed is high (>6000 rpm). Park position a is most suitable for when inertia is low, such as when rotor velocity/engine speed is low (e.g. <3000 rpm). The intermediate park position b enables fine tuning for intermediate rotor velocities/engine speeds. The controller 50 can implement the required park position in dependence on a parameter such as rotor velocity/engine speed. Threshold rotor velocities/engine speeds could be defined in the controller 50 for switching from one target park position to the next, to minimise a requirement for stator assistance.

In one example, the controller 50 could cause the rotor 102 to reach park position a after a low-speed valve lift event and rotate no further because travelling up the rest 1085 of the flank 1082 to position 0 would require parasitic stator energy consumption. In dependence on planning a higher-speed valve lift event, the controller 50 could rotate the rotor 102 in reverse from park position a because the inertia will be sufficient for park position b to be reached without stator assistance. If an even higher speed valve lift event is planned subsequently, the rotor 102 could be rotated forward or in reverse for reaching park position 0.

When at an intermediate position a or b, the controller 50 may determine whether to 'charge' up the rest 1085 or 1087 of the flank 1082 or 1083 to position 0. This may be permissible when the stator 101 does not have any higher priority loads such as meeting a target rotor velocity. For example, climbing from position a or b to 0 may not be achievable during the valve closing phase of a fast-valve closing event. However, the climb may be achievable between valve lift events.

Although FIG. 10 illustrates the ERS lobe 108 having a staged profile, the same principles could be applied to a different component in the force path to the cantilever spring 116, such as a roller on the ERS rocker 110 or any other suitable component. Further, although three park positions are shown, more or fewer could be provided.

Figure 11:
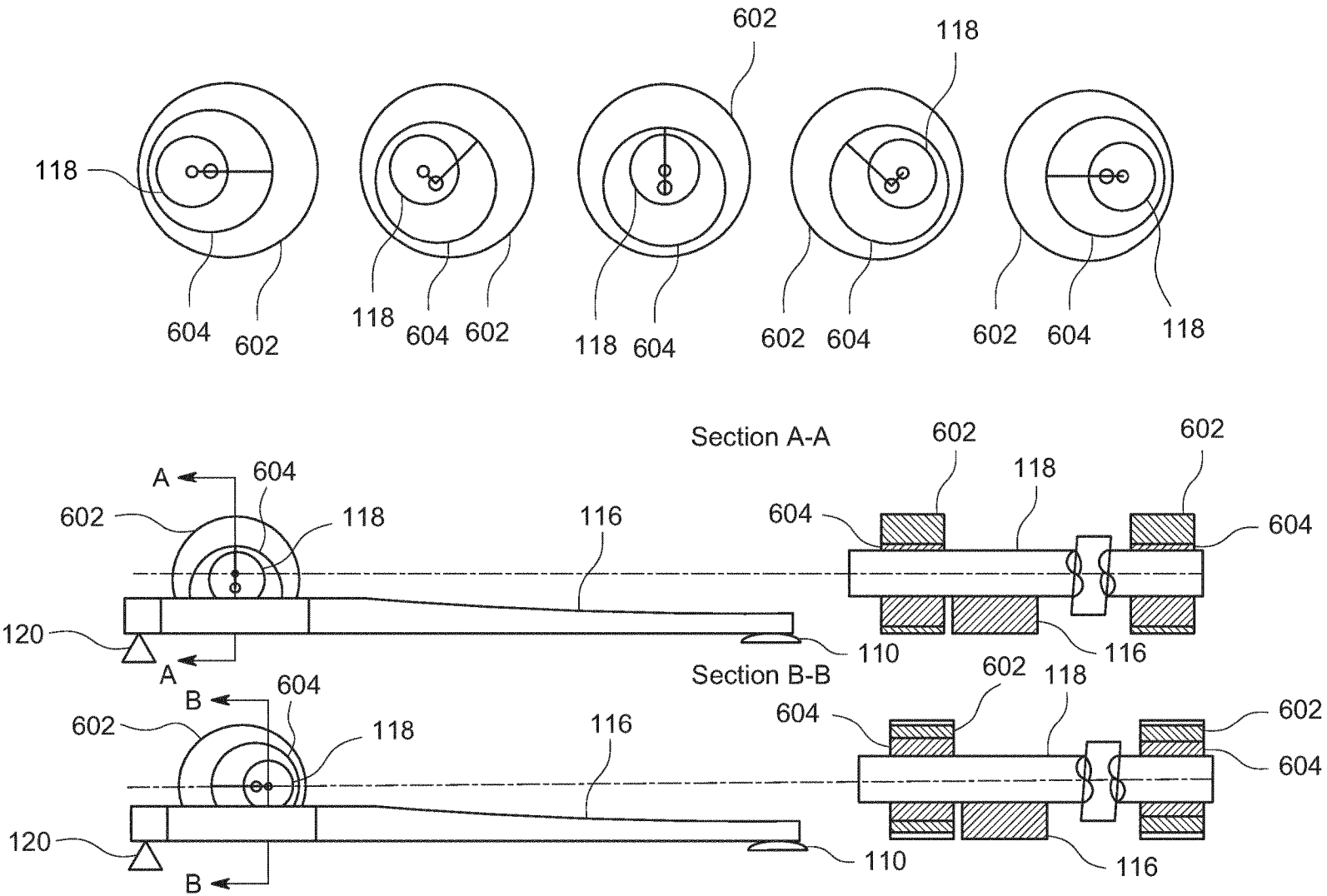
FIG. 11 illustrates an example of lever arm length adjusting means.

FIG. 11 relates to the second example implementation discussed earlier. FIG. 11 is an illustration of the principle of adjusting the amount of energy storable in the mechanical energy storage means, similar to FIG. 9, and a possible implementation.

The difference from FIG. 9 is that there is no lost motion, and instead a characteristic of the resilient means (e.g. cantilever spring 116) itself is changed. FIG. 11 shows that the length of the lever arm can be adjusted in operation. The lever arm is defined as the distance of the contact point of the input (e.g. ERS rocker 110) to the fulcrum 118. By moving either the location of the input or the fulcrum 118 or both, the lever arm length can be adjusted. FIG. 11 illustrates an example of moving the fulcrum 118 but the same principles apply to moving the input, e.g. the contact point of the ERS rocker 110.

Once the lever arm length has been adjusted, a given amount of deflection defined by the lift of the ERS lobe 108 results in a different amount of elastic potential energy being stored in the cantilever spring 116.

FIG. 11 illustrates that the fulcrum 118 is movable between two positions. This defines two lengths of the lever arm. The diagram on FIG. 11 through which section A-A is cut shows a first position of the fulcrum 118 defining a first lever arm length, and the diagram on FIG. 11 through which section B-B is cut shows a second position of the fulcrum 118 defining a second longer lever arm length increasing the effective spring rate.

FIG. 11 shows that the position of the fulcrum 118 is also adjustable between the two extreme positions. The five upper cross-sections of FIG. 11 illustrate five positions of the fulcrum 118, although more or fewer positions could be provided in various examples. In some implementations, the fulcrum position is continuously adjustable to enable a fine level of control of lever arm length.

According to FIG. 11, the fulcrum 118 is adjusted by sliding the fulcrum 116 without necessarily breaking contact between the fulcrum 118 and the cantilever spring 116. This can be achieved with any appropriate actuator, although FIG. 6 illustrates a double eccentric mechanism to give an example.

The double eccentric mechanism comprises an outer eccentric 602 and an inner eccentric 604. The fulcrum is fixed to (or integral with) the inner eccentric 604 off-center from its axis of rotation. The outer diameter of the larger outer eccentric 602 can be caused to rotate in a housing (not shown), and the inner eccentric 604 contained within the outer eccentric 602 can be caused to rotate in the opposite direction, such that the shaft of the fulcrum 118 through the inner diameter of the inner eccentric 604 slides in a straight line along the direction of the cantilever spring 116. The five relative orientations of the fulcrum, inner eccentric 604 and outer eccentric 602, and the resulting positioning of the fulcrum while it moves horizontally (generally parallel to the longitudinal axis of the spring 116) can be seen at the top of FIG. 11.

The second (longer) lever arm length (upper configuration in FIG. 11) is most suitable for when inertia is high such as when rotor velocity/engine speed is high (>6000 rpm), to maximise energy recovery. The first lever arm length (lower configuration in FIG. 11) is most suitable for when inertia is low, such as when rotor velocity/engine speed is low (e.g. <3000 rpm). An intermediate lever arm length could be determined for intermediate rotor velocities/engine speeds. As with the other examples, the controller 50 can implement the required park position in dependence on a parameter such as rotor velocity/engine speed. Threshold rotor velocities/engine speeds could be defined in the controller 50 for switching from one lever arm length to the next, to minimise a requirement for stator assistance. Rotor velocities/engine speeds could even be mapped to lever arm length in a continuously variable manner if the lever arm length is continuously adjustable.

For purposes of this disclosure, it is to be understood that the controller(s) 50 described herein can each comprise a control unit or computational device having one or more electronic processors 52. A vehicle 10 and/or a system thereof may comprise a single control unit or electronic controller or alternatively different functions of the controller(s) may be embodied in, or hosted in, different control units or controllers. A set of instructions 56 could be provided which, when executed, cause said controller(s) or control unit(s) to implement the control techniques described herein (including the described method(s)). The set of instructions may be embedded in one or more electronic processors, or alternatively, the set of instructions could be provided as software to be executed by one or more electronic processor(s). For example, a first controller may be implemented in software run on one or more electronic processors, and one or more other controllers may also be implemented in software run on or more electronic processors, optionally the same one or more processors as the first controller. It will be appreciated, however, that other arrangements are also useful, and therefore, the present disclosure is not intended to be limited to any particular arrangement. In any event, the set of instructions described above may be embedded in a computer-readable storage medium 58 (e.g., a non-transitory computer-readable storage medium) that may comprise any mechanism for storing information in a form readable by a machine or electronic processors/computational device, including, without limitation: a magnetic storage medium (e.g., floppy diskette); optical storage medium (e.g., CD-ROM); magneto optical storage medium; read only memory (ROM); random access memory (RAM); erasable programmable memory (e.g., EPROM ad EEPROM); flash memory; or electrical or other types of medium for storing such information/instructions.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An electromagnetic valve actuator for at least one valve of an internal combustion engine, the electromagnetic valve actuator comprising:

a rotor;

a stator configured to rotate the rotor;

an output arranged on the rotor, the output configured to actuate the at least one valve based on rotation of the rotor;

a mechanical energy storage device arranged to alternately store and release energy based on the rotation of the rotor so as to assist the stator in rotating the rotor when the energy is released; and a phase varying device for varying a phase between the mechanical energy storage device and the output.

2. The electromagnetic valve actuator of claim 1, wherein, when in a first phase between the mechanical energy storage device and the output, the mechanical energy storage device starts to store the energy at a first timing while the at least one valve is open.

3. The electromagnetic valve actuator of claim 2, wherein, when in the first phase, the mechanical energy storage device releases the energy while the at least one valve is closed.

4. The electromagnetic valve actuator of claim 2, wherein, when in a second phase between the mechanical energy storage device and the output, the mechanical energy storage device starts to store the energy at a second timing that is retarded relative to the first timing.

5. The electromagnetic valve actuator of claim 4, wherein the second timing occurs while the valve is closed.

6. The electromagnetic valve actuator of claim 4, wherein the second phase is offset from the first phase by at least 10 degrees and at most 30 degrees.

7. The electromagnetic valve actuator of claim 1, wherein the stator is further configured to reverse a direction of rotation of the rotor with the assistance of the mechanical energy storage device when the at least one valve has reached a target peak lift less than a maximum peak lift.

8. The electromagnetic valve actuator of claim 1, wherein when assisting in the rotating of the rotor, a ratio of a torque supplied by the mechanical energy storage device to a torque supplied by the stator is at least 0.40 and at most 0.95.

9. The electromagnetic valve actuator of claim 1, wherein the mechanical energy storage device comprises a cantilever spring.

10. The electromagnetic valve actuator of claim 1, wherein the mechanical energy storage device comprises a cam or an eccentric.

11. The electromagnetic valve actuator of claim 1, wherein the phase varying device is configured to vary a phase of the mechanical energy storage device or the output relative to the rotor.

12. The electromagnetic valve actuator of claim 1, further comprising an engine control unit (ECU) configured to control the phase varying device.

13. The electromagnetic valve actuator of claim 12, wherein, when the ECU determines a parameter indicative of kinetic energy has exceeded a threshold, the ECU controls the phase varying device to switch the phase from (i) a second phase in which the mechanical energy storage device starts to store the energy after the at least one valve is closed to (ii) a first phase in which the mechanical energy storage device starts to store the energy when closing the at least one valve.

14. The electromagnetic valve actuator of claim 13, wherein, when in the second phase, the ECU is further configured to control the stator to apply torque to the rotor such that the mechanical energy storage device starts to store the energy after the at least one valve is closed.

15. The electromagnetic valve actuator of claim 13, wherein, when in the second phase, the ECU is further configured to control the stator to apply torque to the rotor when closing the at least one valve.

16. The electromagnetic valve actuator of claim 12, wherein:

the ECU is further configured to determine when a switch from a partial valve lift mode to a full valve lift mode is required, when in the partial valve lift mode, the ECU is further configured to control the stator to reverse a direction of rotation of the rotor when the at least one valve has reached a target peak lift less than a maximum peak lift, and when the ECU determines a parameter indicative of kinetic energy has exceeded a threshold, the ECU controls the phase varying device to switch the phase from (i) a second phase in which the mechanical energy storage device starts to store the energy after the at least one valve is closed to (ii) a first phase in which the energy storage starts after the maximum peak lift.

17. The electromagnetic valve actuator of claim 12, wherein:

when in a partial valve lift mode, the ECU is further configured to determine when a switch from a first target peak lift of the at least one valve to second target peak lift of the at least one valve is required, when the at least one valve has reached the first or second target peak lift, the ECU is further configured to control the stator to reverse a direction of rotation of the rotor, and when the ECU determines the switch from the first target peak lift to the second target peak lift is required, the ECU controls the phase varying device to vary the phase.

18. An internal combustion engine comprising the electromagnetic valve actuator of claim 1.

19. A vehicle comprising the internal combustion engine of claim 18.

* * * * *